US012709864B2

(12) United States Patent
Gold et al.

(10) Patent No.: US 12,709,864 B2
(45) Date of Patent: Aug. 18, 2026

(54) HYDROVAC WITH AUTO SHUTOFF BASED ON WEIGHT

(71) Applicant: Brandt Industries Canada Ltd., Regina (CA)

(72) Inventors: Evrhetton Gold, Regina (CA); Daniel Bonnet, Regina (CA)

(73) Assignee: Brandt Industries Canada Ltd., Regina (CA)

( * ) Notice: Subject to any disclaimer, the term of this patent is extended or adjusted under 35 U.S.C. 154(b) by 333 days.

(21) Appl. No.: 18/607,146

(22) Filed: Mar. 15, 2024

(65) Prior Publication Data

US 2025/0290274 A1 Sep. 18, 2025

(51) Int. Cl.

| | |
|---|---|
| ***E02F 3/90*** | (2006.01) |
| ***E02F 3/88*** | (2006.01) |
| ***E02F 3/92*** | (2006.01) |
| ***E02F 9/22*** | (2006.01) |
| ***E02F 9/24*** | (2006.01) |

(52) U.S. Cl.

CPC ..... *E02F 3/907* (2013.01); *E02F 3/8825* (2013.01); *E02F 3/9262* (2013.01); *E02F 9/226* (2013.01); *E02F 9/24* (2013.01)

(58) Field of Classification Search

CPC ..... E02F 3/907; E02F 3/8825; E02F 3/9262; E02F 9/226; E02F 9/24

See application file for complete search history.

(56) References Cited

U.S. PATENT DOCUMENTS

| | | | | |
|---|---|---|---|---|
| 5,425,188 | A * | 6/1995 | Rinker | B01D 46/0002 175/206 |
| 7,255,116 | B2 * | 8/2007 | Crocker | E01H 1/103 210/194 |
| 7,378,950 | B2 * | 5/2008 | Lehnen | E02F 9/085 212/277 |
| 11,255,072 | B1 * | 2/2022 | Fesi | E02F 7/04 |
| 2018/0073216 | A1 * | 3/2018 | Holt | E02F 3/8816 |
| 2022/0042276 | A1 * | 2/2022 | Rajewski | E02F 3/8825 |
| 2023/0007983 | A1 * | 1/2023 | Wichmann | E02F 3/8825 |

* cited by examiner

*Primary Examiner* — Jamie L McGowan

(74) *Attorney, Agent, or Firm* — FBT Gibbons LLP; Nicole M. Tepe

(57) ABSTRACT

A method of shutting down operations of a hydrovac when a weight limit is reached is provided. A current weight of the hydrovac is determined and this current weight of the hydrovac is compared to a weight limit. When the current weight of the hydrovac reaches the weight limit, an emergency shutoff valve is opened to vent a debris tank to atmosphere, a boom isolation assembly is closed to isolate a vacuum hose from the debris tank, and a power take-off is disengaged to stop a blower creating a vacuum in the debris tank.

14 Claims, 18 Drawing Sheets

HYDROVAC WITH AUTO SHUTOFF BASED ON WEIGHT

The present invention relates to a hydrovac with an automatic shutoff based on the weight of the hydrovac.

BACKGROUND

Traditionally, excavation was performed using excavators, skid steers and/or backhoes and even manually digging with hand tools, such as shovels. However, in some cases excavation in this manner can cause damage and even be dangerous. For example, when excavating around utilities to expose them for repair or replacement, these machines can accidentally damage the utilities and even causes serious injuries or death if the utilities are high power electrical lines and the machinery or hand tools accidentally cuts through them.

More recently, hydro-evacuation trucks or "hydrovacs" are more commonly being used for excavation and particularly excavation around utilities. Hydrovacs use high pressure streams of water to cut into soil. This water liquifies the soil making into a slurry that can then "vacuumed" up by the hydrovac into the tank on the hydro-evacuation truck, along with any rocks and other debris contained into the slurry. Typically, the mixture of water, soil and rock in the tank of the hydro-evacuation truck cannot be used for backfill for the excavated hole because of the moisture content, so it has to be carried in the tank by the hydro-evacuation truck to a dump site.

Hydro-evacuation has many advantages over more traditional mechanical and physical labor based excavation, including significantly reducing the risks of excavating to expose utility lines (commonly referred to as "daylighting") because the high pressure stream of water and vacuuming of the resulting water and soil mixture is very unlikely to damage buried utilities. It can also be used with heated water to improve its performance with frozen soil.

Because the hydrovacs are trucks, local laws and regulations will govern how much load (debris) a hydrovac can carry in payload before becoming overweight. The weight of the debris collected with each operation must be below this weight limit. If an operator completely fills the hydrovac with dense debris, the hydrovac could go overweight.

While an operator may try and monitor the weight of the debris being collected by the hydrovac, it is desirable in some cases to have the hydrovac stop suctioning up debris when a weight limit is reached or is being approached.

SUMMARY OF THE INVENTION

In a first aspect, a hydrovac is provided. The hydrovac having a frame, a cab mounted near a front end of the frame, an engine mounted on the frame, a transmission connected to the engine, the transmission comprising at least one power take-off, the at least one power take-off connected to at least one hydraulic pump, steering wheels operative to steer the hydrovac, ground wheels connected to the frame and operative to be driven by the engine through the transmission, a debris tank mounted on the frame, a vacuum hose fluidly connected to the debris tank, the vacuum hose having a distal end, a boom pivotally mounted at a first end and carrying the vacuum hose, a blower operatively connected to the debris tank and operative to create a vacuum in the debris tank, a hydraulic motor connected to the blower to drive the blower, the hydraulic motor connected to the at least one hydraulic pump, an emergency shutoff valve connected in fluid communication with the debris tank, a boom isolation assembly which in an open position places the debris tank in fluid communication with the vacuum hose and in a closed position fluidly isolates the debris tank from the vacuum hose, and a controller. The controller having at least one processing unit, an output interface operatively connectable to the engine, the transmission, the emergency shutoff valve, and the boom isolation assembly, and at least one memory containing program instructions. The controller is operative to determine a current weight of the hydrovac, compare the current weight to a weight limit, in response to the current weight reaching the weight limit, open the emergency shutoff valve, in response to the current weight reaching the weight limit, close the boom isolation assembly, and in response to the current weight reaching the weight limit, disengage the at least one power take-off.

In a further aspect, the hydrovac also has at least one water tank, a pressure sensor measuring a pressure of the water at a bottom of the water tank, and at least one load cell measuring the weight of the debris tank. The controller also has an input interface operatively connected to the pressure sensor and the at least one load cell and the current weight of the hydrovac is determined using a predetermined empty weight of the hydrovac, a determined weight of the water in the water tank using a measurement from the pressure sensor, and, a determine weight of debris in the debris tank using a measurement from the at least one load cell.

In a further aspect, the hydrovac also has a fuel tank and the controller is further operative to use a determined weight of fuel in the fuel tank to determine the current weight of the hydrovac.

In another aspect, a controller for controlling the operation of hydrovac is provided. The hydrovac can have an engine, a transmission connected to the engine, the transmission having at least one power take-off, the at least one power take-off connected to at least one hydraulic pump, ground wheels operative to be driven by the engine through the transmission; a debris tank, a vacuum hose fluidly connected to the debris tank, a boom pivotally mounted at a first end and carrying the vacuum hose, a blower operatively connected to the debris tank and operative to create a vacuum in the debris tank, a hydraulic motor connected to the blower to drive the blower, the hydraulic motor connected to the at least one hydraulic pump, an emergency shutoff valve connected in fluid communication with the debris tank, and, a boom isolation assembly which in an open position places the debris tank in fluid communication with the vacuum hose and in a closed position fluidly isolates the debris tank from the vacuum hose. The controller can have at least one processing unit, an output interface operatively connected to the engine, the transmission, the emergency shutoff valve, and the boom isolation assembly, and at least one memory containing program instructions. The at least one processing unit, responsive to the program instructions, is operative to determine a current weight of the hydrovac, compare the current weight to a weight limit, in response to the current weight reaching the weight limit, open the emergency shutoff valve, in response to the current weight reaching the weight limit, close the boom isolation assembly, and in response to the current weight reaching the weight limit, disengage the at least one power take-off.

In a further aspect, the hydrovac can have at least one water tank, a pressure sensor measuring a pressure of the water at a bottom of the water tank, and at least one load cell measuring the weight of the debris tank and the controller further can have an input interface operatively connected to the pressure sensor and the at least one load cell. The current weight of the hydrovac is determined using a predetermined empty weight of the hydrovac, a determined weight of the water in the water tank using a measurement from the pressure sensor, and, a determine weight of debris in the debris tank using a measurement from the at least one load cell.

In a further aspect, the hydrovac can have a fuel tank and wherein the controller is further operative to use a determined weight of fuel in the fuel tank to determine the current weight of the hydrovac.

DESCRIPTION OF THE DRAWINGS

A preferred embodiment of the present invention is described below with reference to the accompanying drawings, in which.

DETAILED DESCRIPTION

Figure 1:
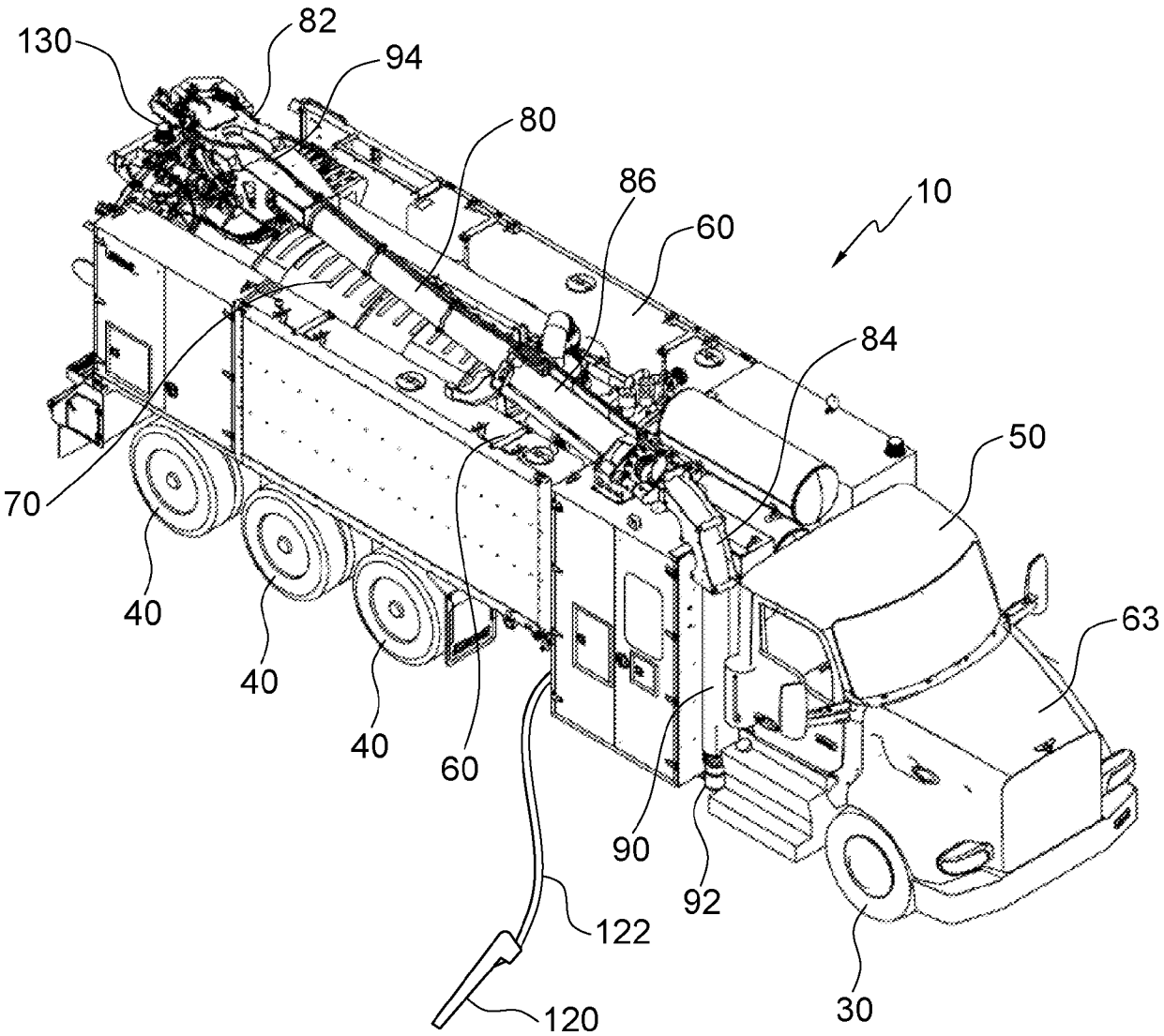
FIG. 1 is a perspective view of a hydrovac.
Figure 2:
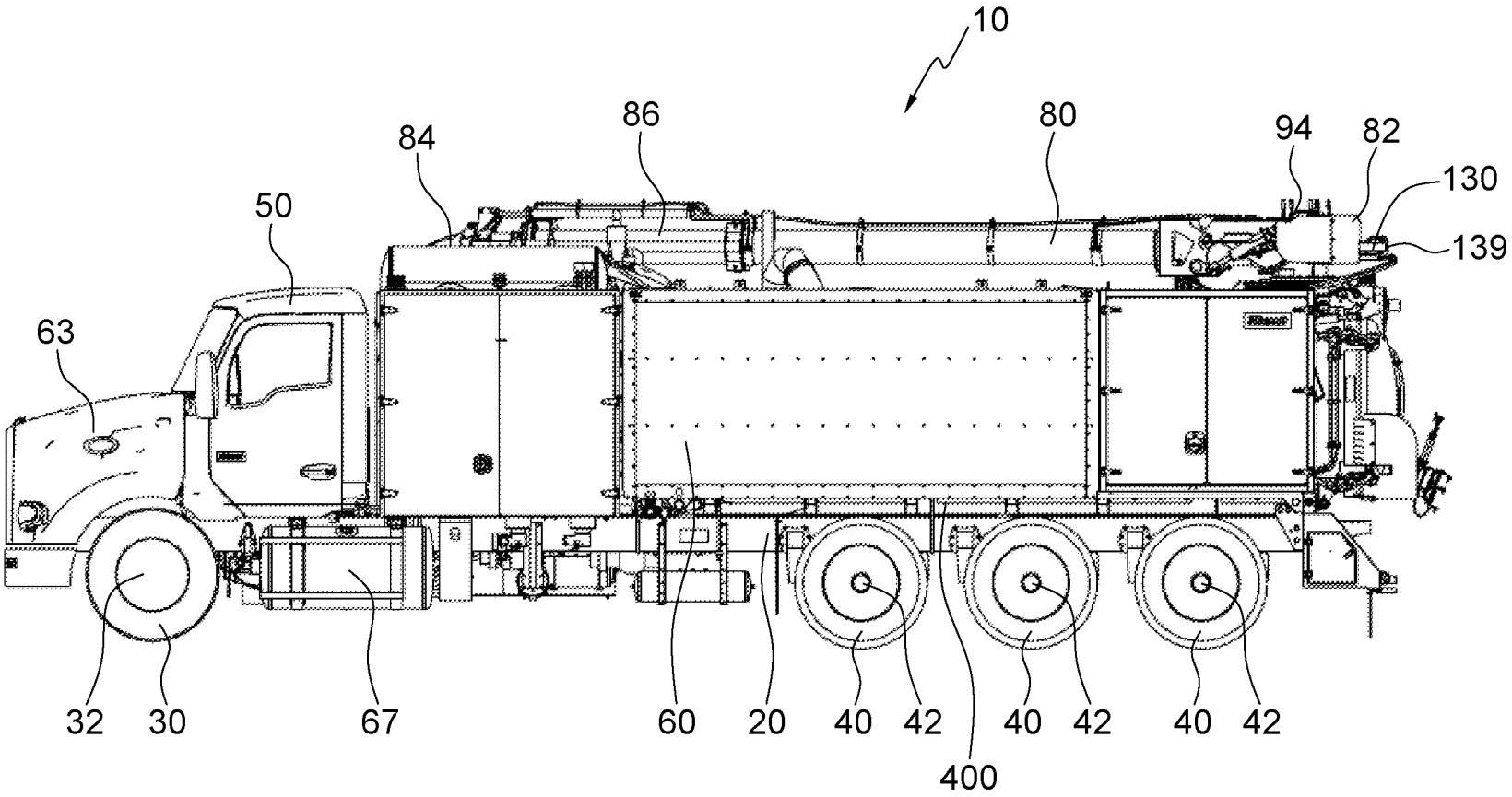
FIG. 2 is driver side view of the hydrovac of FIG. 1.
Figure 3:
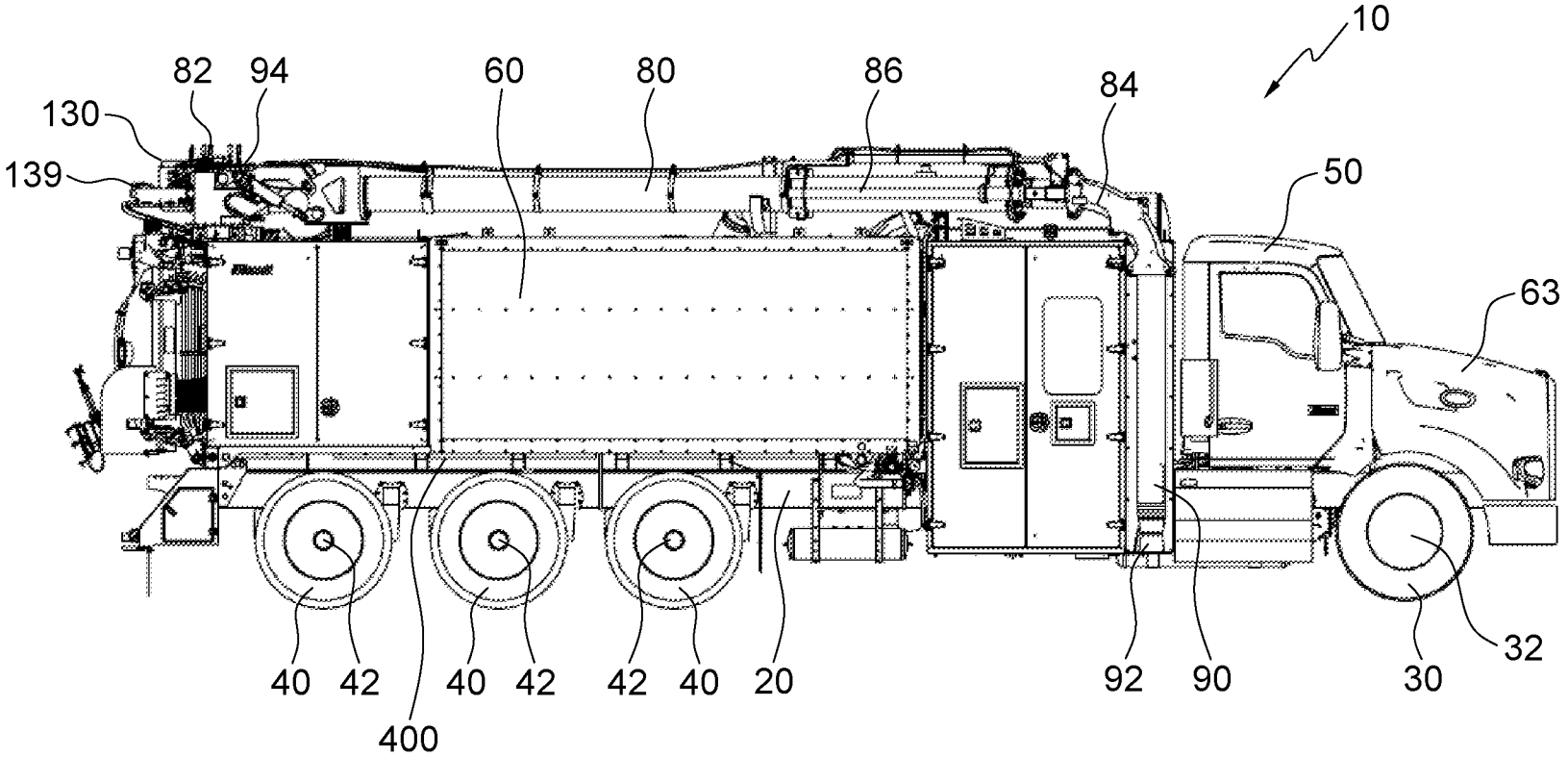
FIG. 3 is a passenger side view of the hydrovac of FIG. 1.
Figure 4:
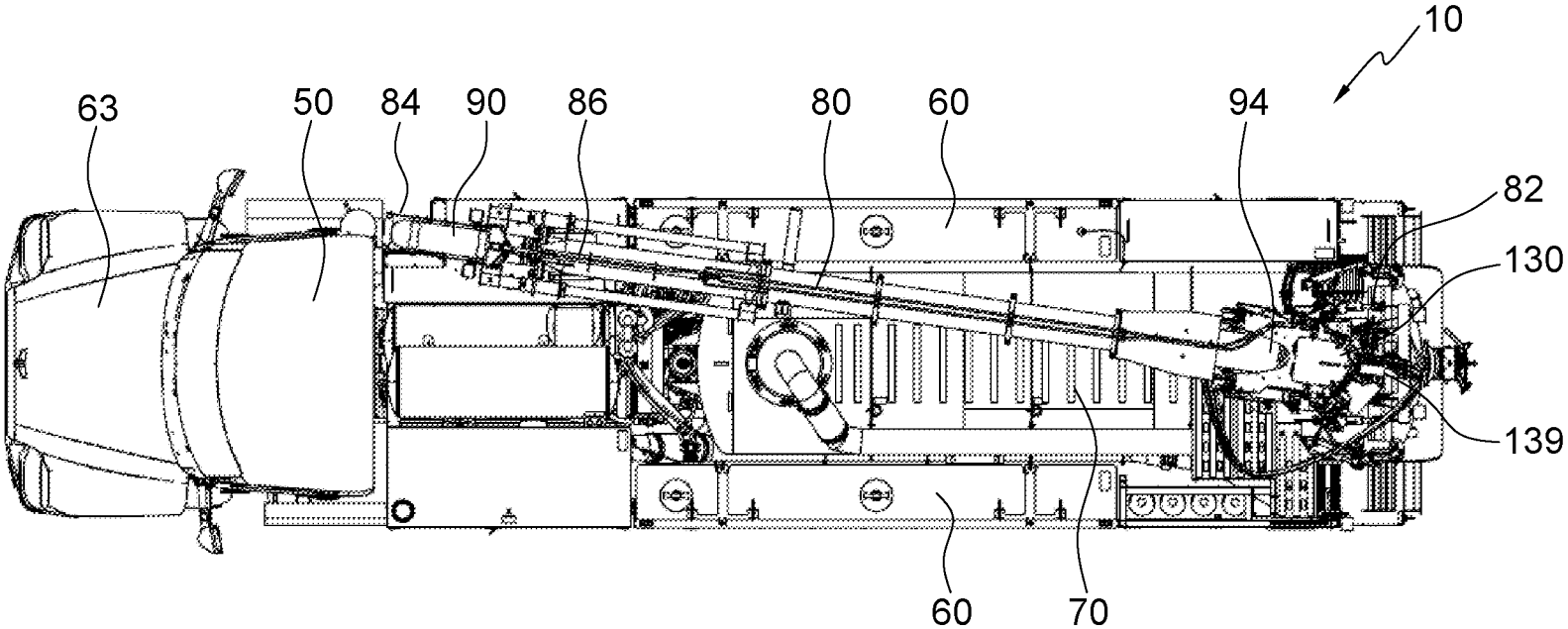
FIG. 4 is a top view of the hydrovac of FIG. 1.

FIGS. 1-8 illustrate a hydro-evacuation truck or a hydrovac 10 for performing hydro-excuvations. The hydrovac 10 can include: a frame 20; steering wheels 30; ground wheels 40; a cab 50; an engine 63; a transmission 65; one or more water tanks 60; a fuel tank 67; a debris tank 70; a boom 80; a vacuum hose 90; a blower 100; a controller 200; a water pump 110; a dig wand 120; and, an emergency shut off valve 170.

The frame 20 is supported by the steering wheels 30 and the ground wheels 40. The frame 20 supports the various components of the hydrovac 10. The steering wheels 30 are positioned near the front of the frame 20 and operative to steer the hydrovac 10. The steering wheels 30 can be provided on an axle 32. The ground wheels 40 are operative to be driven by the engine 63 and move the frame 20 and therefore the hydrovac 10. The drive wheels 40 can be provided on axles 42.

Figure 9:
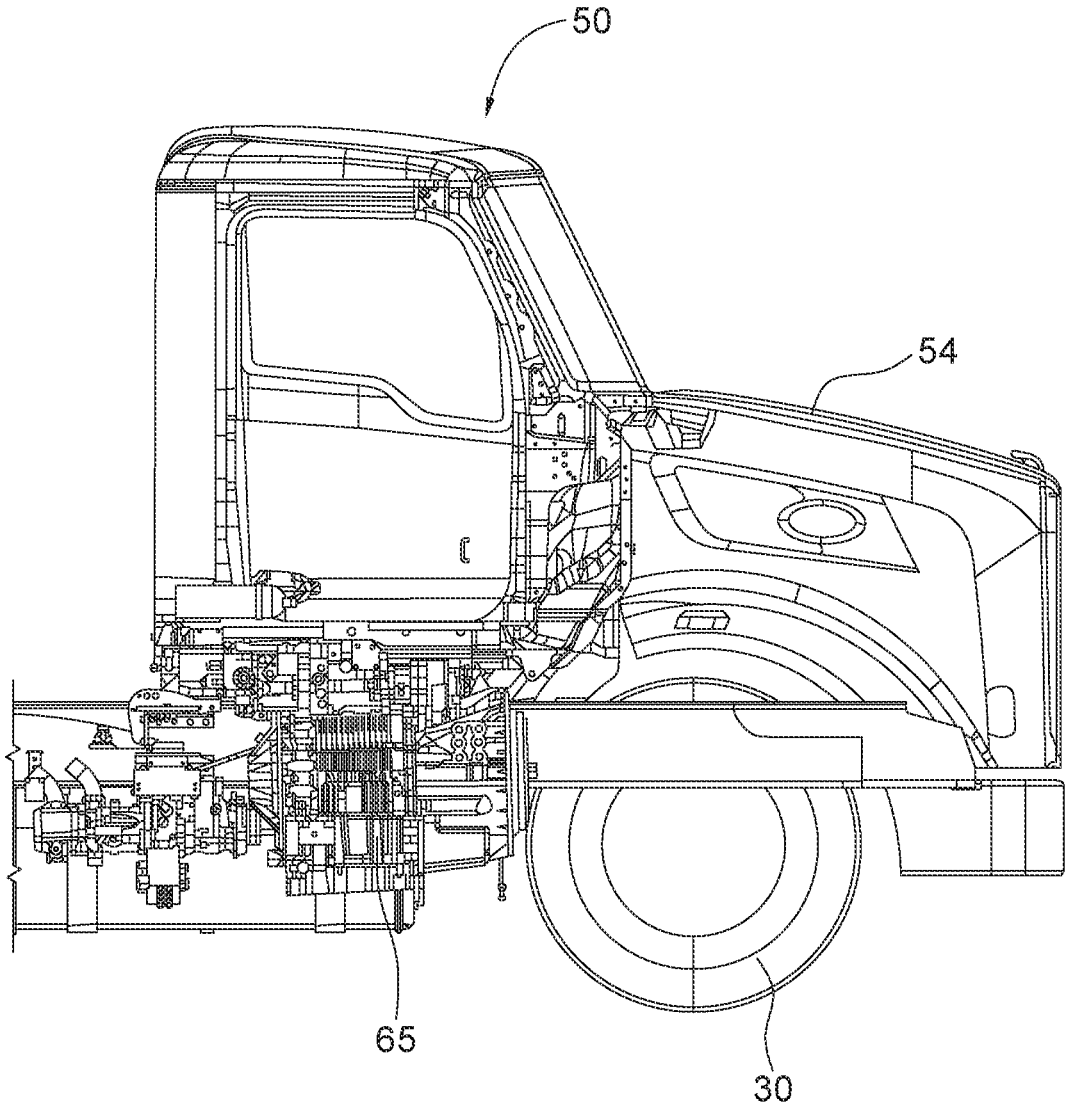
FIG. 9 is a schematic view of a cab and transmission of a hydrovac.

The cab 50 can be mounted near a front end of the frame 20. Referring to FIG. 9, the cab 50 can contain a passenger compartment 52 and a hood 54 enclosing the engine (not shown), such as an internal combustion engine. The engine can be connected to the transmission 65.

The steering wheels 30 can be steered from the passenger compartment 52 of the cab 50 and the transmission 65 can be connected to the axles of the ground wheels 40 to drive the ground wheels 40 and move the hydrovac 10.

Figure 10:
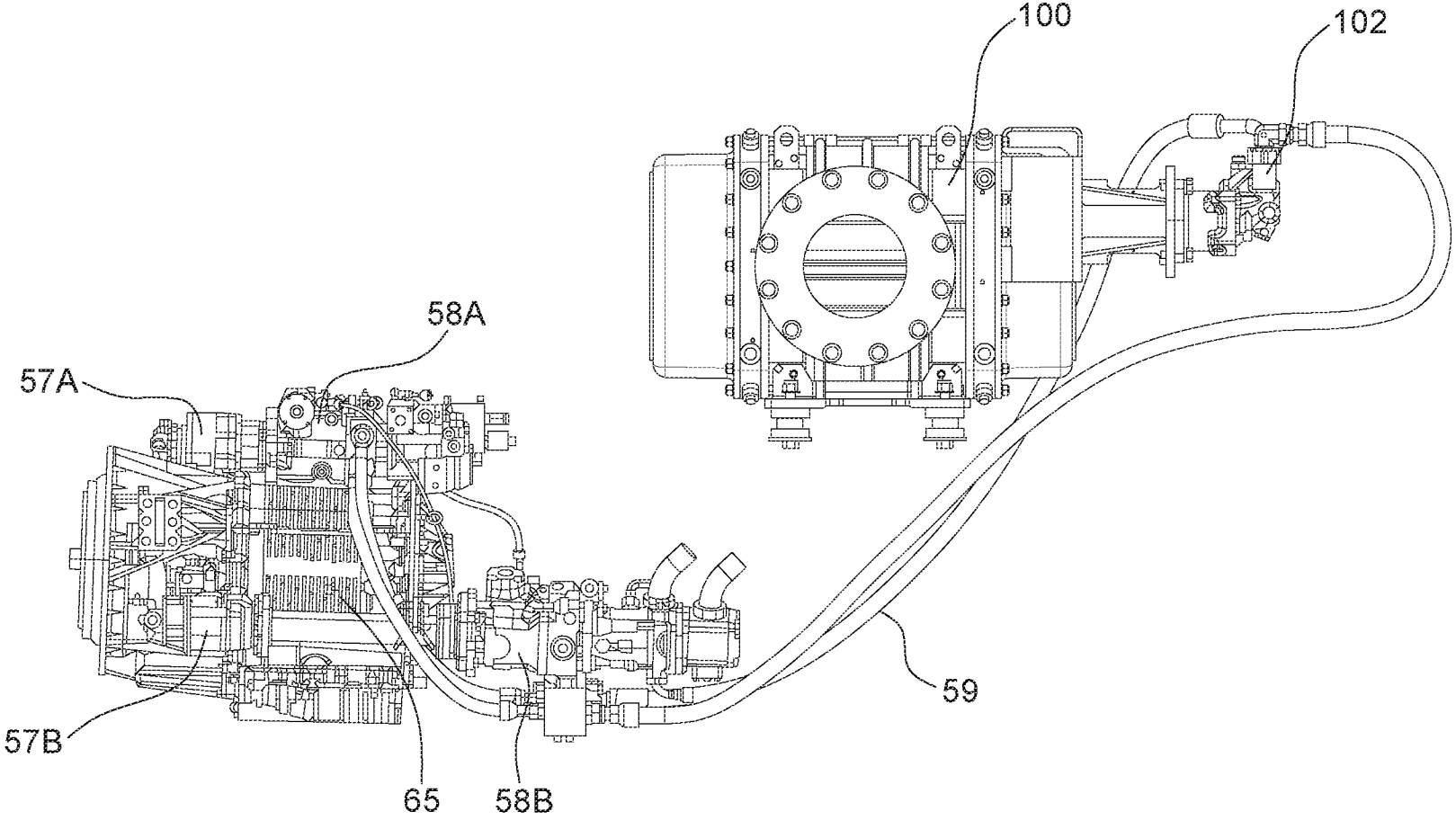
FIG. 10 is a schematic view of the transmission and power take-off powering a blower.

Referring to FIG. 10, the transmission 65 can also contain power take-offs (PTOs) 57A, 57B. The first PTO 57A can be connected to a first hydraulic pump 58A and the second PTO 57B can be connected to a second hydraulic pump 58B that routes hydraulic fluid through hydraulic lines 59 to a hydraulic motor 102 that powers the blower 100. When the PTOs 57A, 57B are engaged, the speed of the engine 63 will determine how fast the PTOs 57A, 57B turn and therefore the rpms of the hydraulic pumps 58A, 58B. The faster the hydraulic pumps 58A, 58B are rotated, the greater the flow the of hydraulic fluid flowing through the hydraulic fluid lines 59 to the hydraulic motor 102 and the faster the hydraulic motor 102 is driven. The hydraulic motor 102 drives the blower 100, so the faster the hydraulic motor 102 is rotated by the hydraulic fluid, the faster the blower 100 operates.

Figure 5:
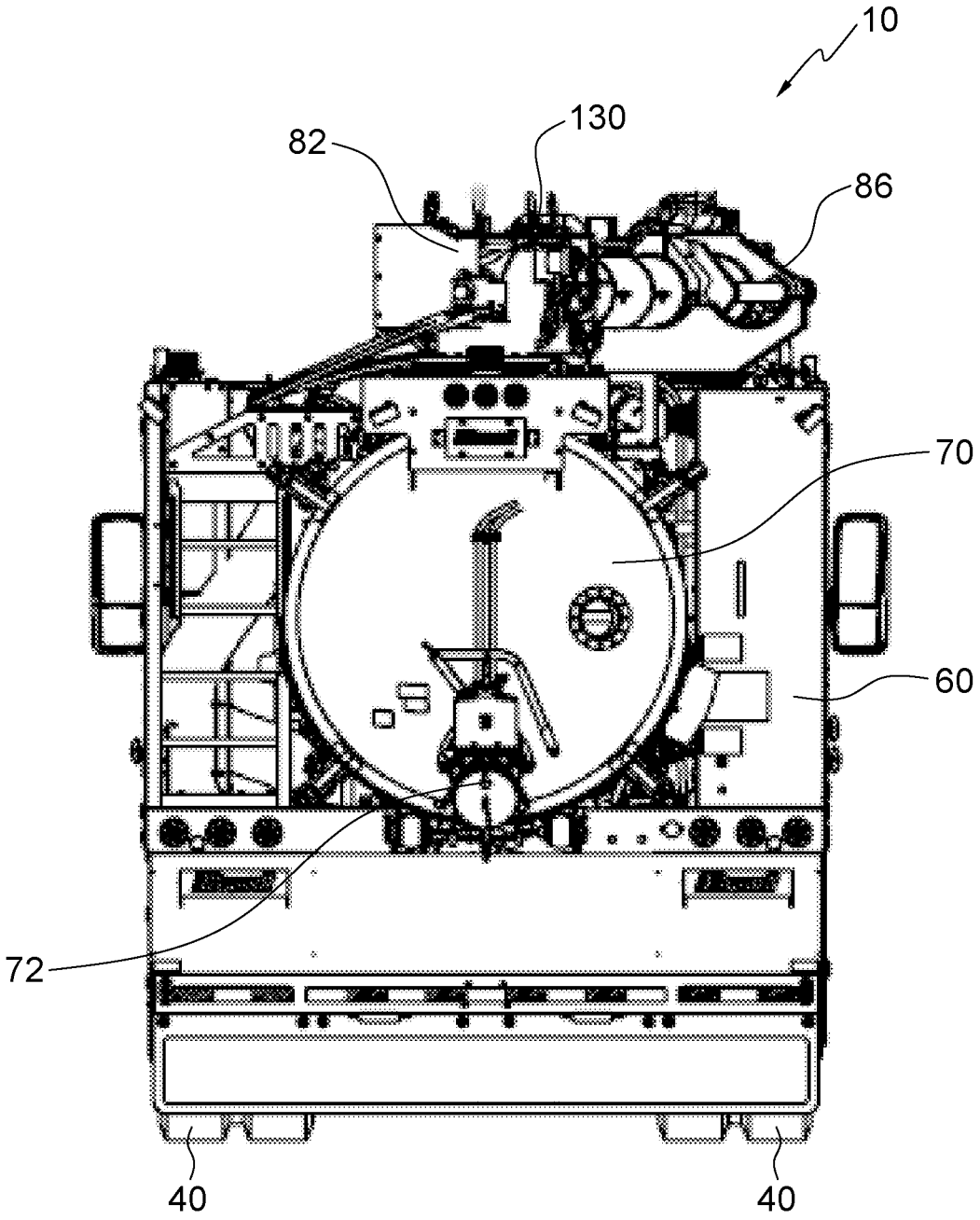
FIG. 5 is a rear view of the hyrdovac of FIG. 1.

Referring again to FIGS. 1-8, the debris tank 70 can be mounted on the frame 20 behind the cab 50 with a rear end of the debris tank 70 positioned proximate a rear end of the hydrovac 10. The debris tank 70 can be used to store the soil and water slurry vacuumed up by the hydrovac 10. The debris tank 70 allows the slurry vacuumed up by the hydrovac 10 to be stored in the hydrovac 10 during its operation and then transported by the hydrovac 10 in the debris tank 70 to a dump site for disposal when the excavation is complete or the debris tank 70 is full. Referring to FIG. 5, the debris tank 70 can have a drain door 72 at the rear end of the debris tank 70 which can be opened to allow the debris tank 70 to be emptied or dumped out.

Referring again to FIGS. 1-8, the debris tank 70 can be provided with hydraulics so that a front end of the debris tank 70 can be lifted upwards, slanting the debris tank 70 downwards towards its rear end to aid dumping out the debris tank 70.

The boom 80 can be mounted proximate the rear end of the hydrovac 10 to carry the vacuum hose 90 and to maneuver the vacuum hose 90 to a side of the hydrovac 10 and in some cases even pivot the boom 80 around behind the hydrovac 10. In one aspect, the boom 80 can only maneuver the vacuum hose 90 to one side of the hydrovac 10, such as the passenger side of the hydrovac 10. The boom 80 allows the vacuum hose 90 to be maneuvered into a desired positioned to allow the vacuum hose 90 to suck up soil and any rocks or other debris that have been liquified into a slurry. The boom 80 can be pivotally mounted at a first end 82 so that the boom 80 can be pivoted from side to side around is first end 82 as well as being pivoted upwards and downwards around the first end 82 of the boom 80. A second end 84 of the boom 80 can be curved downwards to direct the vacuum hose 90 downwards towards a ground surface being excavated.

In one aspect, the boom 80 might have an extendable section 86 that allows the length of the boom 80 to be extendable and retractable to better enable an operator to maneuver the second end 84 of the boom 80 and therefore the vacuum hose 90 to a desired position.

The vacuum hose 90 can have a distal end 92. With portion of the vacuum hose 90 supported by the boom 80 and running along the boom 80, the distal end 92 of the vacuum hose 90 extends past the second end 84 of the boom 80 to that the distal end 92 of the vacuum hose 90 and can be directed downwards towards the ground surface. An operator can position the distal end 92 of the vacuum hose 90 where they desire by pivoting the boom 80 from side to side and up and down.

When the hydrovac 10 is not in use or is going to be transported to another location, the boom 80 can be placed in a transport position with the boom 80 swung over top of the hydrovac 10, so that the second end 84 of the boom 80 and the vacuum hose 90 do not extend past the sides of the hydrovac 10. The boom 80 can be pivoted downward to be positioned against a top of the hydrovac 10.

The vacuum hose 90 can be flexible to allow it to bend so that it can bend as it is maneuvered by the boom 80 and bend downwards around the curved second end 84 of the boom 90 so that the distal end 92 of the vacuum hose 90 points downwards towards a ground surface to be excavated.

A dig tube (not shown) made of a rigid material, like aluminum, etc. can be attachable to the distal end 92 of the vacuum hose 90. This rigid dig tube can prevent damage and deformation to the vacuum hose 90 because it will be the dig tube that comes directly into contact with the liquified soil and other debris and is vacuumed up the dig tube first before the slurry enters then the vacuum hose 90 connected to the dig tube.

In one aspect, a portion of the vacuum hose 90 can be flexible while another portion of the vacuum hose 90 might be formed of rigid tubing, made of a rigid material such as metal. For example, a portion of the vacuum hose 90 that extends past the second end 84 of the boom 80 could be flexible tubing, while a portion of the vacuum hose 90 that runs along the boom 80 could be rigid tubing.

Figure 7:
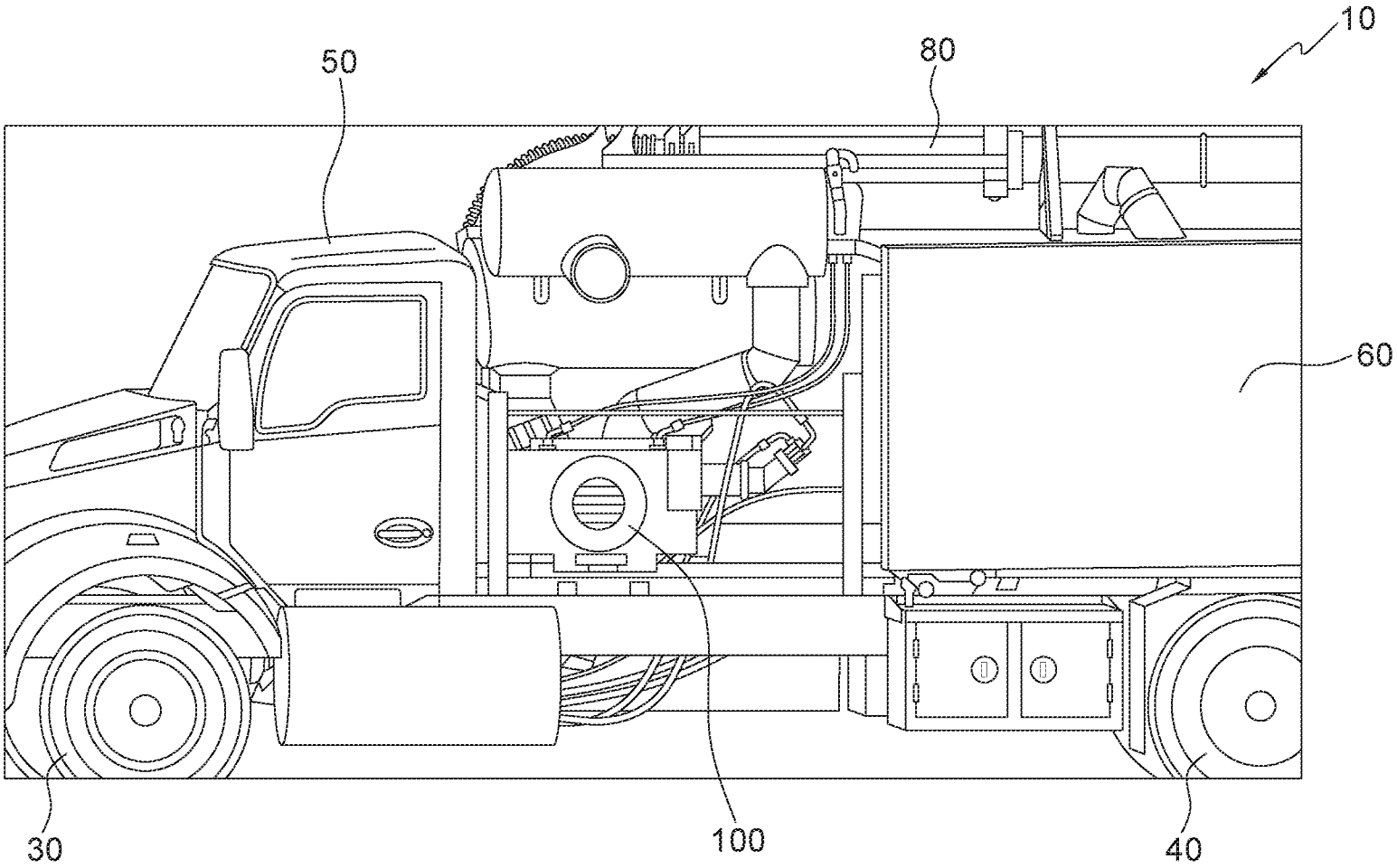
FIG. 7 is a schematic illustration of a blower behind the equipment compartment in FIG. 6.

Referring to FIG. 7, the blower 100 can be used to create a vacuum in the debris tank 70. The vacuum hose 90 can be in fluid communication with the debris tank 70 and by creating a vacuum in the debris tank 70 suction will be created in the vacuum hose 90, allowing the vacuum hose 90 to suck a soil and water slurry through the vacuum hose 90 and into the debris tank 70. Referring again to FIG. 10, the blower 100 can be driven by the hydraulic motor 102 that is supplied with hydraulic fluid from hydraulic pumps 58A, 58B which in turn are driven off the first PTO 57A and the second PTO 57B of the transmission 65. The faster the blower 100 is driven, the more vacuum that is created by the blower 100.

Figure 11:
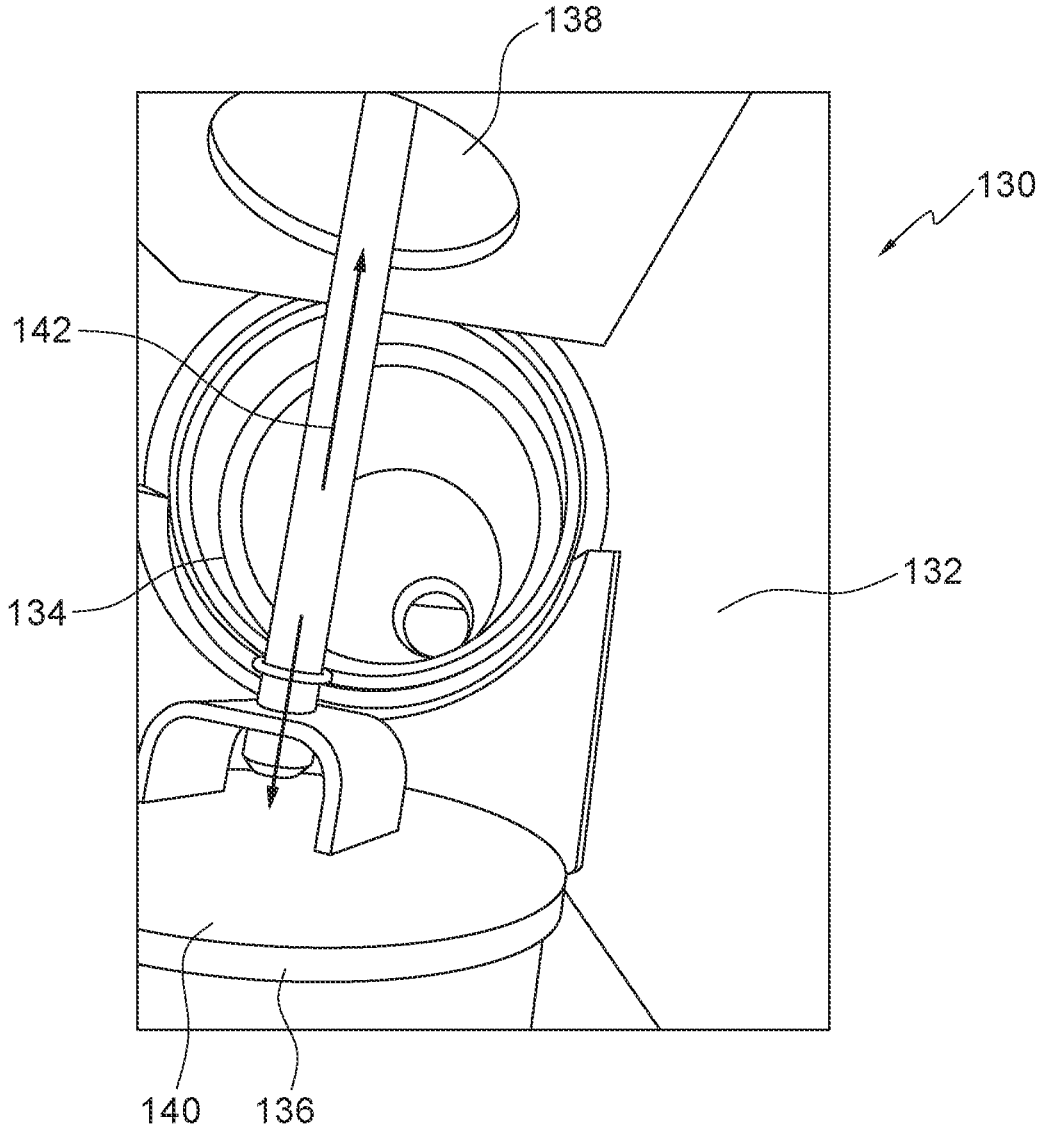
FIG. 11 is an illustration of a boom isolation assembly.

Referring again to FIGS. 1-8, a boom isolation assembly 130 can be provided at the first end 82 of the boom 80 and at a proximal end 94 of the vacuum hose 90 to isolate the vacuum hose 90 from the debris tank 70 and cut off suction created in the vacuum hose 90 from a vacuum in the debris tank 70. Referring to FIG. 11, the boom isolation assembly 130 can have: a chamber 132 with an inlet 134 in the bottom leading to the debris tank 70; a first opening 136 leading to the proximal end 94 of the vacuum hose 90; a second opening 138 on the opposite side of the chamber 132; a plate 140 sized to fit in the first opening 136 and the second opening 138; a rod 142 connected to the plate 140; and an actuator 139 (shown in FIGS. 2-4), such as a hydraulic cylinder, to move the rod 142 and therefore the plate 140 between the first opening 136, blocking the first opening 136, and the second opening 138, blocking the second opening 138.

During operation of the hydrovac 10, the boom isolation assembly 130 can be in an open position placing the debris tank 70, and a vacuum created in the debris tank 70, through the inlet 134, in fluid communication with the vacuum hose 90 and creating suction in the vacuum hose 90. The actuator 139 can be retracted, moving the plate 140 into the second opening 138 and placing the vacuum in the debris tank 70 in fluid communication with the vacuum hose 90, creating suction in the vacuum hose 90 and allowing rock, soil slurry and other debris to be sucked through the vacuum hose 90, through the inlet 134 in the chamber 132, and into the debris tank 70. Debris sucked through the vacuum hose 90 will enter the chamber 132 through the first opening 136, some of which can slam into opposite wall of the chamber 132 and the plate 140 positioned in the second opening 138 and fall through the inlet 134, into the debris tank 70.

Closing the boom isolation assembly 130 can isolate the debris tank 70 from the vacuum hose 90, stopping a vacuum in the debris tank 70 from creating a suction in the vacuum hose 90 and stopping the vacuum hose 90 from sucking debris and other objects into the vacuum hose 90. The actuator 139 can be extended so that the plate 140 is moved from the second opening 138 to the first opening 136, blocking the first opening 136 leading to the distal end 94 of the vacuum hose 90. This will fluidly isolate the vacuum in the debris tank 70 from the vacuum hose 90, stopping suction in the vacuum hose 90.

Figure 6:
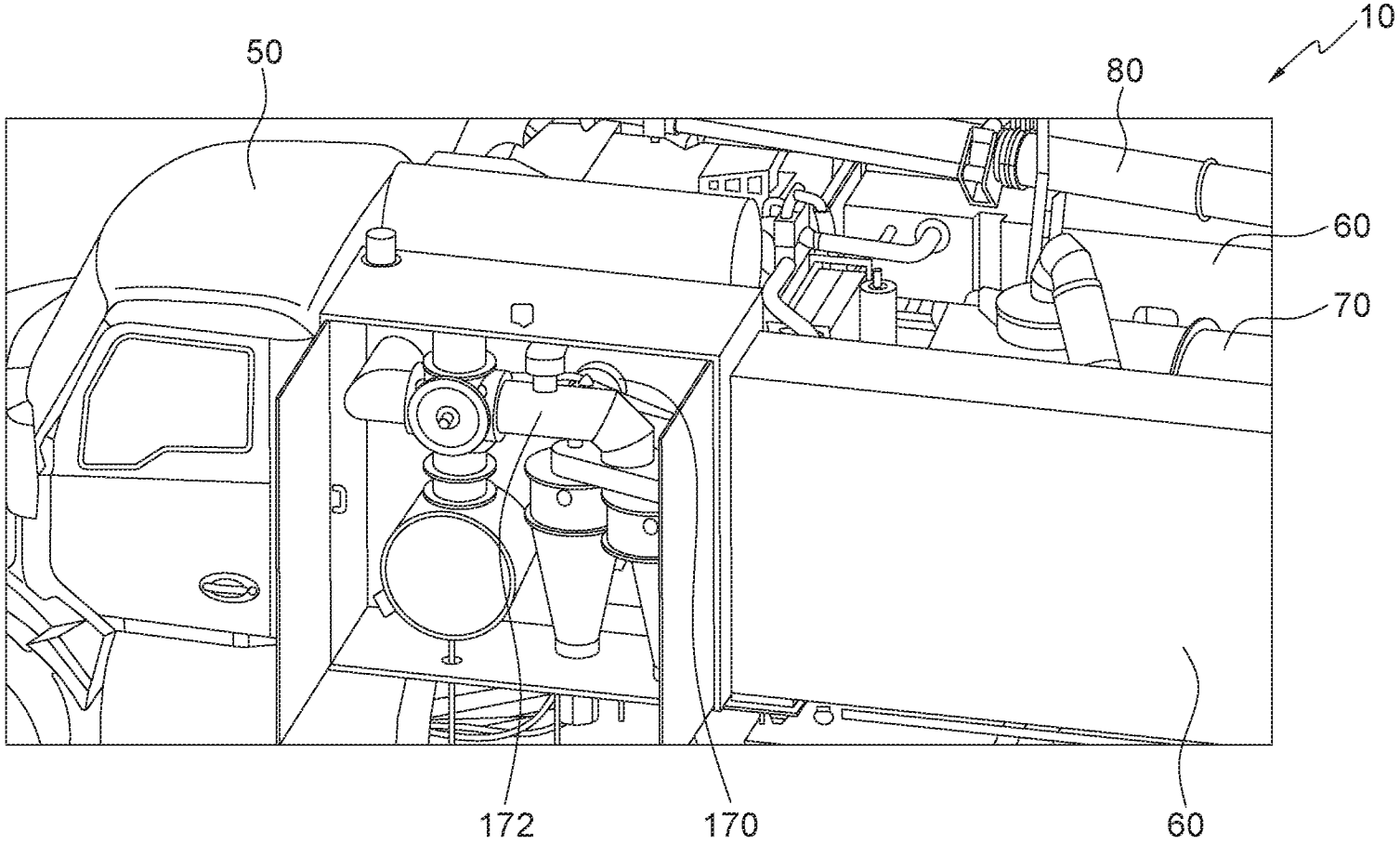
FIG. 6 is a schematic illustration of an equipment compartment on the driver side of the hydrovac of FIG. 1.

FIG. 6 shows the position of the emergency shutoff valve 170 provided in a vacuum conduit 172. The vacuum conduit 172 is in fluid communication with the debris tank 70. The emergency shutoff valve 170 can be a normally open hydraulic valve so that emergency shutoff valve 170 is opened when not supplied with hydraulic fluid. The emergency shutoff valve 170 can have a biasing member, such as a spring, to place the emergency shutoff valve 170 in an open position, venting the vacuum conduit 172 and the debris tank 70 to atmosphere. To create suction, hydraulic fluid can be routed to the emergency shutoff valve 170 to overcome the biasing member and close the emergency shutoff valve 170. When the blower 100 is running, vacuum will be created in the vacuum conduit 172 and thereby suction in the vacuum hose 90 when the emergency shutoff valve 170 is closed.

When hydraulic fluid flow is stopped to the emergency shutoff valve 170, the biasing member will no longer be acted against by the hydraulic fluid and the biasing member will then force the emergency shutoff valve 170 open, venting the vacuum in the vacuum conduit 172 and the debris tank 70 to atmosphere and reducing or even stopping suction in the vacuum hose 90, even if the blower 100 is still running.

Referring again to FIGS. 1-8, the water tanks 60 can be provided on the hydrovac 10 to supply water to the water pump 10 where the water will be pressurized and routed to the dig wand 120. The dig wand 120 can be connected to the hydrovac 10 with a hose 122 to provide pressurized water from the water tanks 60 and the water pump 110 to the dig wand 120.

Figure 8:
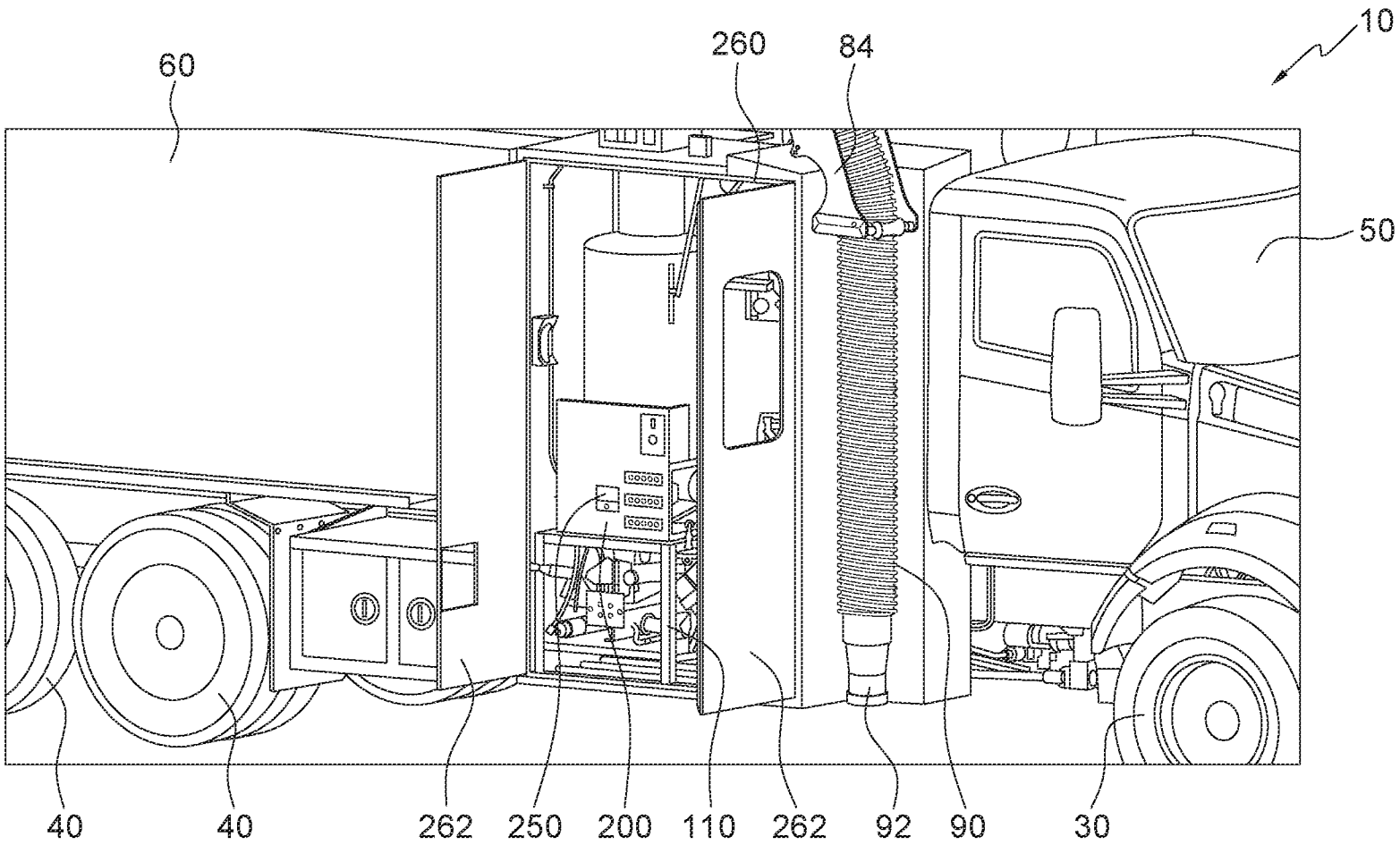
FIG. 8 is a schematic illustration of an equipment compartment on the passenger side of the hydrovac of FIG. 1.

Referring to FIG. 8, the controller 200 can be used to control various components on the hydrovac 10. In one aspect, the controller 200 can control the operation of the blower 100, the water pump 110, the boom 80, the revolutions per minute (RPM) of the engine 63 and the transmission 65.

Figure 12:
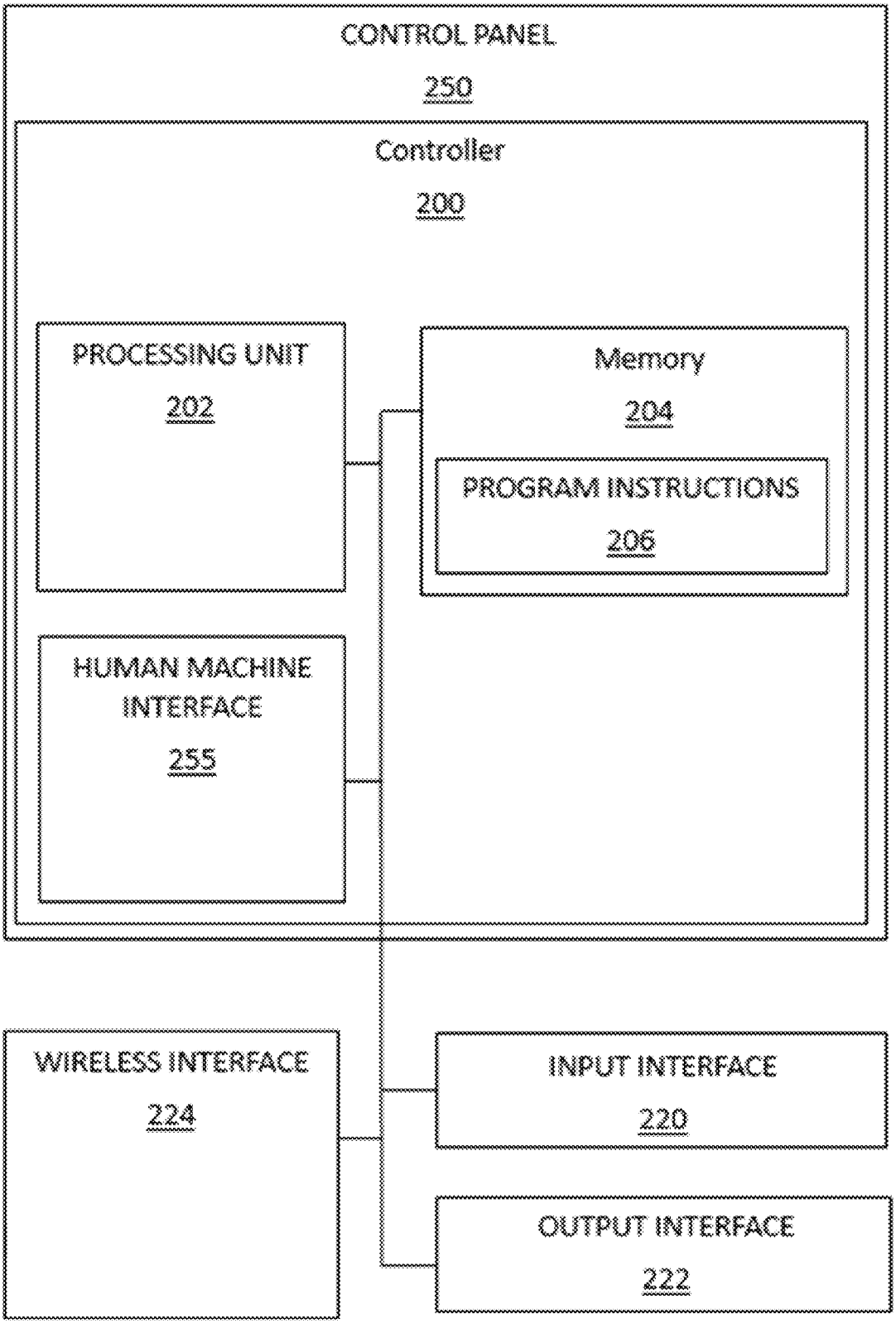
FIG. 12 is a schematic illustration of a controller for the hydrovac.

FIG. 12 is a schematic illustration of the controller 200, in one aspect. The controller 200 can include a processing unit 202, such as a microprocessor, that is operatively connected to a computer readable memory 204 and can control the operation of controller 200. Program instructions 206, for controlling the operation of the processing unit 202, can be stored in the memory 204 as well as any additional data needed for the operation of the controller 200.

A human machine interface 255, such as a touchpad, display and/or keypad, can be used by a user to interact with the controller 200.

A control panel 250 can be used to allow an operator to monitor the operation of the controller 200 and control its operation.

An input interface 220 can be provided operatively connected to the processing unit 202 so that the controller 200 can receive signals from sensors.

Referring to FIGS. 1-8 and 12, an output interface 222 can be provided operatively connected to the processing unit 202 to send signals to other components on the hydrovac 10. The output interface 222 can be connected to engine 63 to control various aspects of the operation of the engine 63, such as the RPM of the engine 63, and the transmission 65 to control when the PTOs 57A, 57B are engaged by the transmission 65. By controlling when the PTOs 57A, 57B are engaged by the transmission 65, the controller 200 can control when the blower 100 is operating. The output interface 222 can also be connected to the water pump 110 to control when the water pump 110 is activated.

The output interface 222 can be connected to the boom 80 to control the operation of the boom 80 as well as the emergency shutoff valve 170, the actuator 139 for the boom isolation assembly 130, the water pump 110, the engine 63, and the transmission 65, as well as other components on the hydrovac 10.

The input interface 320 can be used to receive signals from the various components on the hydrovac 10 to determine the status and operation of these components.

A wireless interface 224 can be used to allow a remote control to wirelessly connected to the controller 200 and allow the remote control to control the operation of various components on the hydrovac 10 through the controller 200.

Referring to FIG. 8, the control panel 250 (and optionally the controller 200) can be located in a storage compartment 260 on a side of the hydrovac 10 for easy access by an operator. The storage compartment 260 can have doors 262 to enclose the control panel 250 when access is not required. The storage compartment 260 can also house the water pump 110 and store a remote control, that controls the operation of the hydrovac 10, when it is not required and, optionally, other components.

Figure 13:
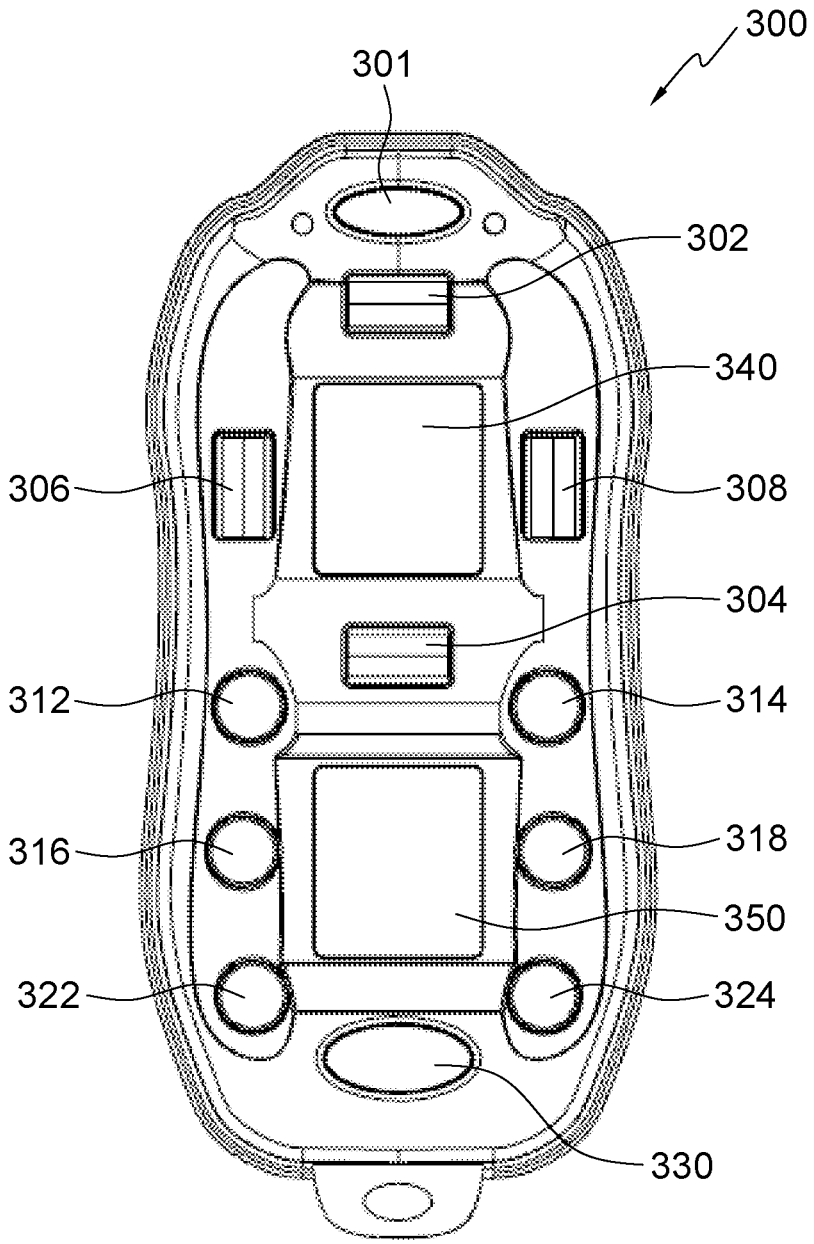
FIG. 13 is a front view of a remote control for operating a hydrovac.

The movement of the boom 80, the operation of the blower 100, creating suction in the vacuum hose 90, and the water pump 110, can be controlled by a remote control that communicates with the controller 200 through the wireless interface 224. FIG. 13 illustrates a remote control 300 that can be used to control the operation of the hydrovac 10 by connecting through the wireless connection 224 of the controller 200 and controlling various components of the hydrovac 10 through the controller 200. In one aspect, the remote control 300 can have: a power on button 301; a boom up button 302; a boom down button 304; a rotate boom counter-clockwise button 306; a rotate boom clockwise button 308; a boom retract button 312; a boom extend button 314; a boom isolation button 316; an eco mode button 318; a water system on/off button 322; a water system pressure increase/decrease button 324; and, an emergency stop button 330. The various buttons can be used to control the operation of the hydrovac 10.

The remote control 300 may also contain one or more display screens for displaying information about the operation of the hydrovac 10, such as a levels screen 340, showing the level of water in the water tanks 60 and the level of debris in the debris tank 70, and a water system pressure screen 350 showing the pressure of the water in the system pressurized by the water pump 110.

Referring to FIGS. 1-8, in operation, the hydrovac 10 can be driven to a location where excavation is required. At the location, an operator can park the hydrovac 10 adjacent to where the excavation will occur and exit the hydrovac 10 to begin the hydro-evacuation process. The operator can then move the boom 80 to maneuver the vacuum hose 90 (such as with the remote control 300) over to one side of the hydrovac 10 towards the soil to be excavated and attach a dig tube to the distal end 92 of the vacuum hose 90. The operator can then maneuver the distal end 92 of the vacuum hose 90 and the attached dig tube over the soil to be excavated.

If the soil to be excavated is not already liquified to create a slurry that can be vacuumed up the vacuum tube 90, the operator can use the dig wand 120 and pressurized water supplied from the water tanks 60 by the water pump 110 to spray the pressurized water into the soil to liquify the soil and create a vacuumable slurry.

The operator can then start the blower 100 to create a vacuum in the vacuum hose 90 and direct the distal end 92 of the vacuum hose 90 towards the liquified soil to vacuum the soil slurry up through the vacuum hose 90 and into the debris tank 70.

When the excavation is complete or the debris tank 70 is full, the operator can stop spraying water with the dig wand 120 and stop the blower 100 from creating a vacuum in the vacuum hose 90. They can then disconnect the dig tube 95 from the distal end 92 of the vacuum hose 90 and maneuver the boom 80 to position the boom 80 and the vacuum hose 90 back over the hydrovac 10 and place it in a transport position. With everything stowed away on the hydrovac 10, the hydrovac 10 can be driven to a dump site and the debris tank 70 emptied.

If the debris tank 70 has hydraulics, the debris tank 70 the drain door 72 can be opened and the debris tank 70 tilted to dump out the contents of the debris tank 70 at the dump site.

Figure 14:
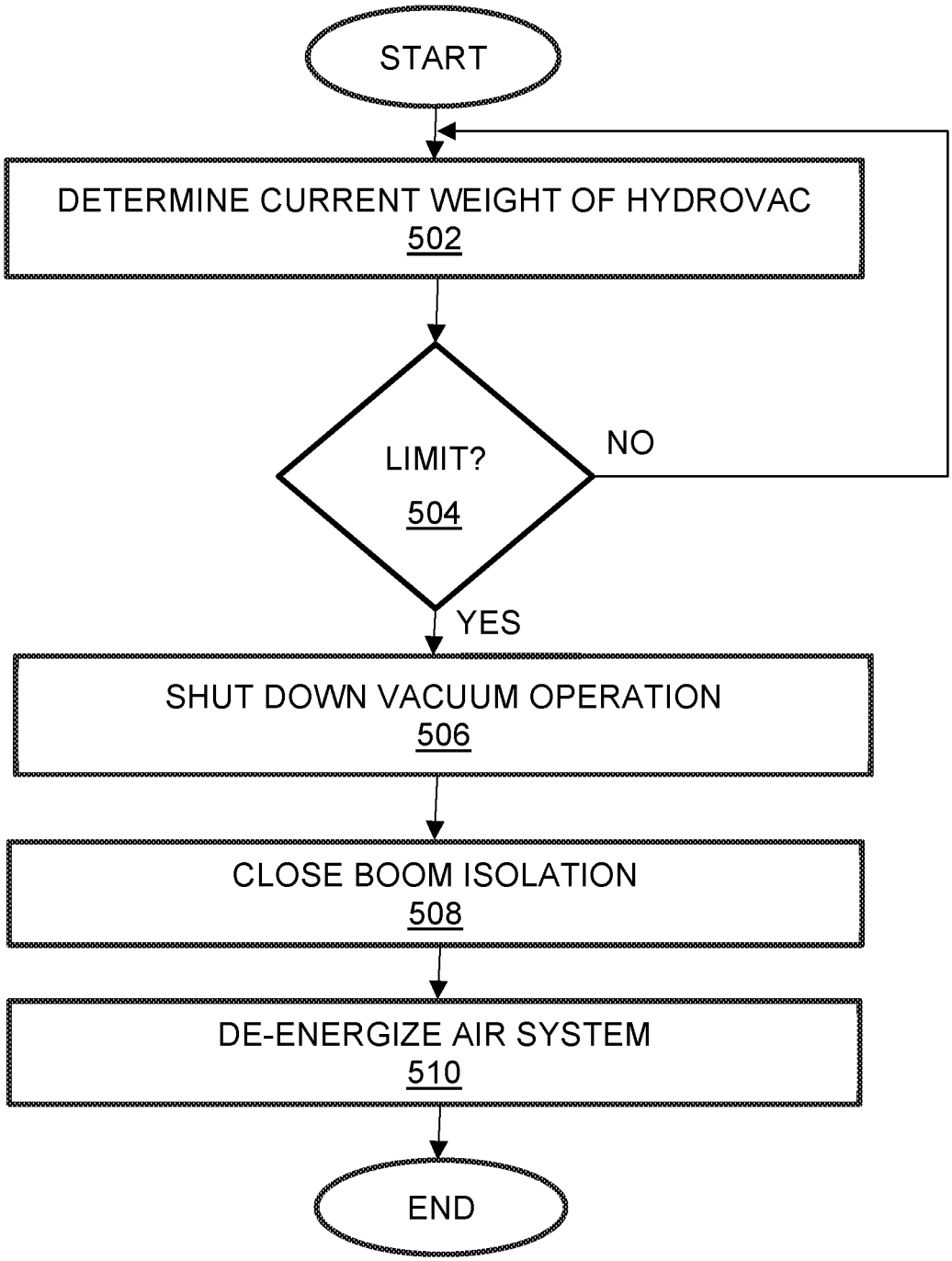
FIG. 14 is a flow chart of a method to stop an operation of a hydrovac in response to determining the hydrovac is overweight.

FIG. 14 illustrates a flow chart to shut down the hydrovac 10 when it reaches or approaches a weight limit. The hydrovac 10 will typically be subjected to local laws and regulations which govern how much load (debris) a hydrovac can carry in payload before becoming legally overweight. Alternatively, there may just be a safe weight that it is desired not to load the hydrovac 10 above. If an operator completely fills the hydrovac 10 with dense debris, the hydrovac 10 could go overweight. With this method, when the hydrovac 10 reaches the set weight limit, the suction of the hydrovac 10 will be stopped preventing an operator from sucking up any additional debris into the debris tank 70 and loading the hydrovac 10 above the weight limit and into an overloaded state.

The method determines a current weight of the hydrovac 10 in real-time while an operator is using the hydrovac 10 to suction up debris into the debris tank 70. As long as the current weight of the hydrovac 10 is not at or approaching a weight limit, the hydrovac 10 will continue operations. However, once the current weight of the hydrovac 10 reaches or approaches the weight limit, the method will proceed and takes steps to shut down the suction of the hydrovac 10 preventing the operation from sucking up any more debris into the debris tank 70.

The method can being at step 502 with the controller 200 determining the current weight of the hydrovac 10 with the amount of debris in the debris tank 70 at that particular time.

The current weight can be determined by a number of means, including monitoring the air pressures in the air suspension of the hydrovac 10 to approximate the current weight of the hydrovac 10. However, in one aspect, measurements of the changing weights of the water in the water tanks 60, debris in the debris tank 60 and fuel in the fuel tank 67 can be added to an empty weight of the hydrovac 10 to determine the current weight of the hydrovac 10.

Figure 15:
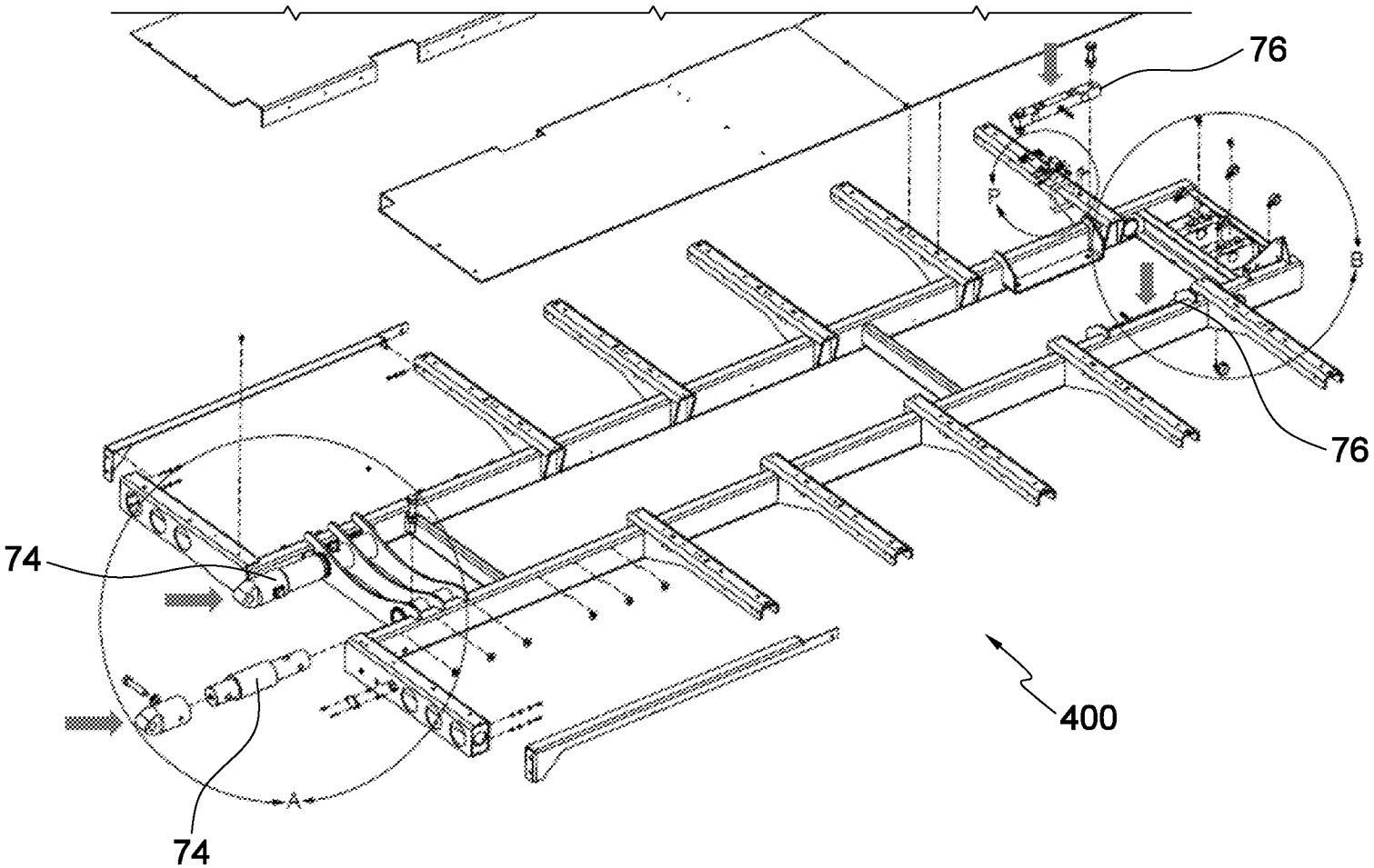
FIG. 15 is a schematic view of load cell sensors for measuring the weight of a debris tank.

To measure the weight of the debris, the debris tank 70 can be mounted on a plurality of load cells 74, 76. Referring to FIG. 15, a substructure 400 is shown that the debris tank 70 and the water tanks 60 can be mounted on (this substructure 400 can also be seen in FIGS. 2 and 3). The debris tank 70 can be mounted on four load cell sensors 74, 76, with two front load cells 74 positioned near the front of the debris tank 70 and two rear load cells 76 positioned near a rear of the debris tank 70. These four load cells 74, 76 combined can measure the weight of the debris tank 70 and the weight of any contents of the debris tank 70.

The load cells 74, 76 can be operatively connected to the input interface 220 of the controller 200 to communicate the measurements of these load cells 74, 76 to the controller 200. By knowing the weight of the debris tank 70 when it is empty, the weight of the contents of the debris tank 70 can be determined by taking the measurements of the load cells 74, 76 and subtracting the weight of the empty debris tank 70.

Figure 16:
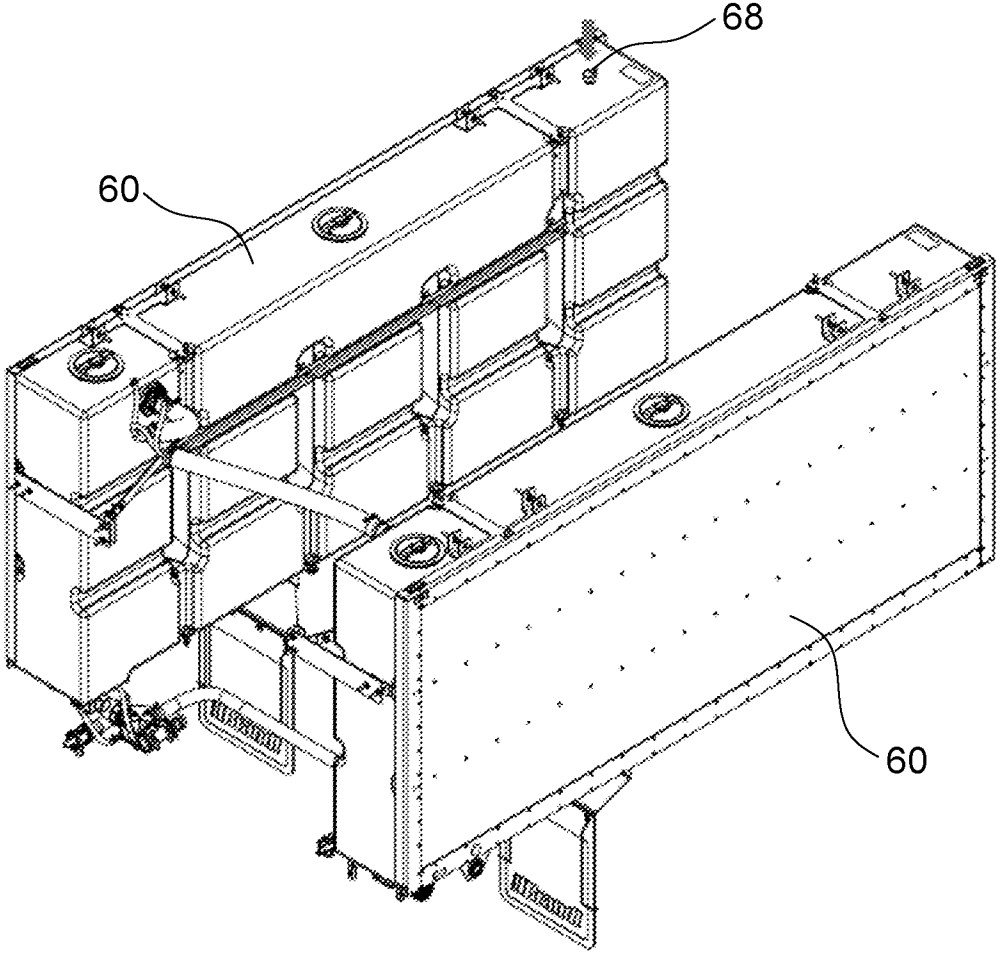
FIG. 16 is a schematic view of water tanks to be mounted on a hydrovac.

Referring to FIG. 16, to determine the amount of water in the water tanks 60 in real-time, a pressure sensor 68 can be provided in the water tank 60, measuring a pressure of the water in the water tank 60 at a bottom of the water tank 60. Using this pressure measurement from the pressure sensor 68 and the dimensions of the water tank 60, including the height of the water tank 60, the volume of the water in the water tank 60 can be determined and using the volume, a weight of the water in the water tank 60 when the measurement was taken can be determined.

The pressure sensor 68 can be operatively connected to the input interface 220 of the controller 200 to communicate the measurements of the pressure sensor 68 to the controller 200.

If the water tanks 60 are the same dimensionally and are fluidly linked so that the water level in each water tank 60 is substantially the same, a single pressure sensor 68 in one of the water tanks 60 could be used to approximate the weight of the water in both water tanks 60.

Optionally, the fuel level can be used to approximate the weight of the fuel in the hydrovac 10 in real time. The amount of fuel in the fuel tank 67 cam be tracked and, using the volume of the fuel tank 67, the weight of the fuel remaining in the fuel tank 67 can be determined.

Figure 17:
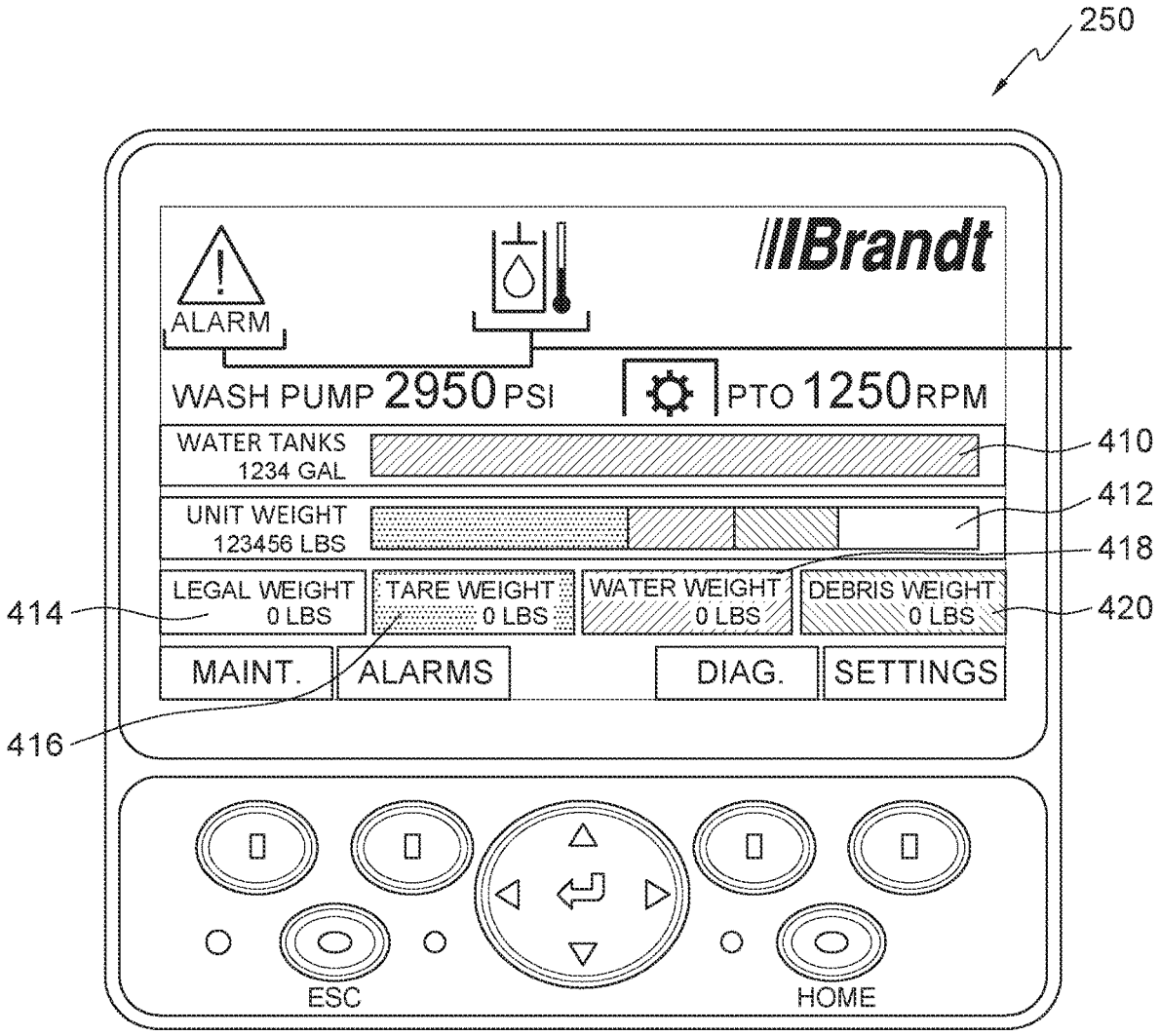
FIG. 17 is an illustration of a display screen on the hydrovac.

Referring to FIG. 17, the control panel 250 is shown that will display a number of measured and calculated weights on the hydrovac 10 to allow an operator to know when to stop sucking up debris into the debris tank 70 so that the hydrovac 10 does not exceed the legal limit for weight. The control panel 250 can display a number of measured and real-time determined weights and other information, such as the water tank level 410, the unit weight 412, the legal weight 414, the tare weight 416, the water weight 418, and the debris weight 420.

The water tank 410 can display the amount of water in the water tanks 60 in real-time, determined by the pressure measurements taken by the pressure sensors 68.

The legal weight 414 can be input into the system and display the weight limit weight allowed for the hydrovac 10. This can be a maximum weight for safety or a legal weight limit for a jurisdiction the hydrovac 10 is operation in. The legal weight limit for can vary by jurisdiction so while it will not change dynamically during operation of the hydrovac 10, it could be inputtable by a user to allow for the jurisdiction the hydrovac 10 is being used in and that jurisdiction's requirements for legal weights.

The tarre weight 416 can display the empty weight of the hydrovac 10 without debris in the debris tank 70, water in the water tanks 60, fuel in the fuel tank 67, etc.

The water weight 418 can display a determined weight of the water on the hydrovac 10 in real-time with the water weight calculated from the pressure sensors 68 in the water tanks 60 and using the dimensions of the water tanks 60 to determine a volume with the weight of water.

The debris weight 420 can display a measured weigh of debris in the debris tank 70 as measured from the load cell sensors 74, 76.

Finally, the unit weight 412 can display a current weight of the hydrovac 10 calculated in real-time using the tare weight, the water weight, the debris weight and a fuel weight.

In one aspect, the controller 200 can use a predetermined empty weight of the hydrovac 10 (the weight of the unloaded or empty hydrovac 10) and add the determined weight of the water in the water tanks 60, the determined weight of the debris in the debris tank 70 to the empty weight of the hydrovac 10 to determine a current weight of the hydrovac 10 at that particular time. This empty weight of the hydrovac 10 (i.e. the tarre weight) can be determined in advance by weighing the hydrovac 10, such as with a weigh scale, when the hydrovac 10 is empty of water, debris, etc. and this measured empty weight can be input to the controller 200 as a constant.

Figure 18:
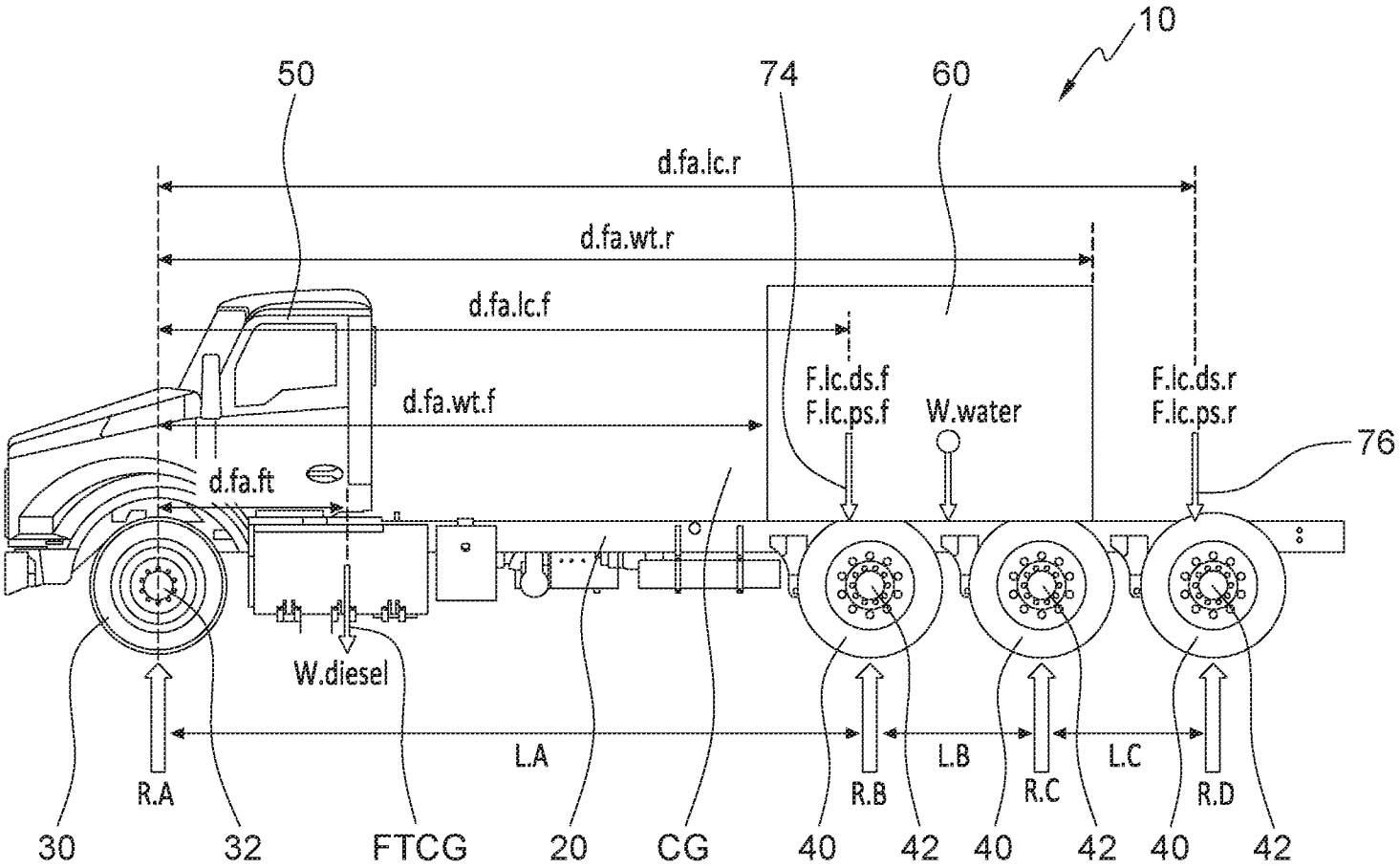
FIG. 18 is a free body diagram illustrating the forces applied to the hydrovac.

Along with, determining an overall current weight of the hydrovac 10 in real-time, the measured and determined weights can be used to determine the weight supported by each axle 32, 42 of the hydrovac 10. FIG. 18 illustrates a two-dimensional free body diagram of the hydrovac 10 that shows how the weight supported by the steering wheels 30 and the axle 32 attached to these steering wheels 30, and the ground wheels 40 and the axles 42 attached to each pair of ground wheel 40 can be determined using the measured weights and the distances these measured weights are acting from the axles 32, 42.

The empty weight of the hydrovac and the center of gravity, CG, of the empty hydrovac 10 can be used as one force acting on the axles 32, 42.

The measured load of the front load cells 74 and their position and the measured load of the rear load cells 74 and their position can be used for the force applied to the hydrovac 10 by debris in the debris tank 70.

The determined weight of the water in the water tanks 60 using the pressure sensors 68 in the water tanks 60 and the position of the water tanks 60 can be used to determine the forces of the water acting on the hydrovac 10.

The weight of the fuel of the hydrovac 10 and the position of center of gravity of the fuel tank 67, FTCG, can be used to determine the forces acting on the hydrovac 10 from the fuel in the fuel tank 67.

With the positions of the axle 32 of the steering wheels 30 and the positions of the axles 42 of the ground wheels 42, and the known positions and forces on the hydrovac 10. The weight each axle 32, 42 is subjected to by the weight of the hydrovac 10 can be determined by the controller 200. With distance L.A. between the front axle 32 and the axle 42 of the front ground wheel 40, the distance L.B. between the axle 42 of the front ground wheel 40 and the axle 42 of the next ground wheel 40, and the distance L.C. between the axle 42 of the middle ground wheel 40 and the axle 42 of the last ground wheel 40, the positions of the axles 32, 42 will be known.

With the distance, d.fa.ft known between the axle 32 of the steering wheels 30 and the center of gravity of the fuel tank 67, the distant between the axle 32 of the steering wheels 30 and the and the center of gravity of the hydrovac 10, CG, the distance, d.fa.wt.f, between the axle 32 of the steering wheels 30 and the front of the water tanks 60, the distance, d.fa.lc.f, between the axle 32 of the steering wheels 30 and the front load cells 74, the distance, d.fa.wt.r, between the axle 32 of the steering wheels 30 and the rear of the water tanks 60, and the distance, d.lc.ds.r, between the axle 32 of the steering wheels 30 and the rear load cells 76, the controller 200 can calculate the forces each axle 32, 42 is subjected to.

With the controller 200 having determined a current weight of the hydrovac 10 at step 502, the controller 200 can move on to step 504 and determine whether this current weight is at the weight limit. This could be that the current weight is at the weight limit set by an operator or could be some weight below the weight limit to allow some time for the hydrovac 10 to be stopped.

In an aspect, the weight limit can be an upper weight any axle 32, 42 is subjected to by the load on the hydrovac 10, a ratio of loads between axles 32, 42, or some other weight parameter.

If at step 504 the controller 200 determines the weight limit has not been reached, the controller 200 can return to step 502 and again determine the current weight of the hydrovac 10 again.

Typically, an operator will be using the hydrovac 10 to suction up liquified debris during the method being performed, so the debris being suctioned up into the debris tank 70 will cause the current weight of the hydrovac 10 to increase over time. Steps 502 and 504 can be repeated, repeatedly determining the current weight of the hydrovac 10 as more and more debris is suctioned up and then comparing the determined current weight of the hydrovac 10 to the weight limit. When at step 504, the controller 200 determines that the current weight of the hydrovac 10 is at the weight limit, the method can move on to step 506 and shut down the suction of the hydrovac 10, which will stop more debris from being sucked into the debris tank 70, stopping the payload of the hydrovac 10 from increasing.

At step 506, the controller 200 can shut down the vacuum operation of the hydrovac 10. The processor 202 of the controller 200 can send a signal through the output interface 222 to stop the flow of hydraulic fluid to the emergency shutoff valve 170. This stopping of the hydraulic fluid flow will remove the force on the emergency shutoff valve 170 that is overcoming the biasing member, causing the emergency shut off valve 170 to open and the debris tank 70 to be vented to atmosphere, thereby decreasing the suction in the system and specifically in the vacuum hose 90.

After the emergency shut off valve 170 is opened at step 506, the method can move onto step 508 and close the boom isolation assembly 130 to isolate any vacuum created in the debris tank 70 from the vacuum hose 90, thereby further reducing or stopping any suction in the vacuum hose 90.

The processing unit 202 can send a signal through the output interface 222 to use the actuator 139 to close the boom isolation assembly 130. Closing the boom isolation assembly 130 will fluidly isolate the vacuum hose 90 from the debris tank 70 and the vacuum created in the debris tank 70 by the blower 100. This will stop suction in the vacuum hose 90.

At step 510, the controller 200 can de-energize the air system. To de-energize the air system, the PTOs 57A, 57B can be disengaged using the transmission 65 and stop the PTOs 57A, 57B from rotating the hydraulic pumps 58A, 58B connected to the PTOs 57A, 57B, thereby depressurizing the hydraulic fluid in the system and stopping the flow of hydraulic fluid hydraulic motor 102 that is driving the blower 100.

The controller 200 can send a signal to the transmission 65 to disengage the PTOs 57A, 57A through the output interface 222.

With the method finished, the hydrovac 10 will be prevented from suctioning up more debris into the debris tank 70, thereby preventing the hydrovac 10 from surpassing the weight limit and entering into an overloaded state.

of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A hydrovac comprising:

a frame;

a cab mounted near a front end of the frame;

an engine mounted on the frame;

a transmission connected to the engine, the transmission comprising:

at least one power take-off, the at least one power take-off connected to at least one hydraulic pump;

steering wheels operative to steer the hydrovac;

ground wheels connected to the frame and operative to be driven by the engine through the transmission;

a debris tank mounted on the frame;

a vacuum hose fluidly connected to the debris tank, the vacuum hose having a distal end;

a boom pivotally mounted at a first end and carrying the vacuum hose;

a blower operatively connected to the debris tank and operative to create a vacuum in the debris tank;

a hydraulic motor connected to the blower to drive the blower, the hydraulic motor connected to the at least one hydraulic pump;

an emergency shutoff valve connected in fluid communication with the debris tank;

a boom isolation assembly which in an open position places the debris tank in fluid communication with the vacuum hose and in a closed position fluidly isolates the debris tank from the vacuum hose; and a controller, comprising: at least one processing unit; an output interface operatively connectable to the engine, the transmission, the emergency shutoff valve, and the boom isolation assembly; and, at least one memory containing program instructions, wherein the controller is operative to:

determine a current weight of the hydrovac;

compare the current weight to a weight limit;

in response to the current weight reaching the weight limit, open the emergency shutoff valve;

in response to the current weight reaching the weight limit, close the boom isolation assembly; and in response to the current weight reaching the weight limit, disengage the at least one power take-off.

2. The hydrovac of claim 1 wherein the controller is further operative to: open the emergency shutoff valve by sending a signal to stop the flow of hydraulic fluid to the emergency shutoff valve.

3. The hydrovac of claim 2 wherein the emergency shut off valve is a normally open hydraulic valve.

4. The hydrovac of claim 1 wherein the transmission comprises: a first power take-off connected to a first hydraulic; and, a second power take-off connected to a second hydraulic pump, and wherein the first hydraulic pump and the second hydraulic pump are connected to the hydraulic motor.

5. The hydrovac of claim 1 wherein the boom isolation assembly comprises:

a chamber;

an inlet in a bottom of the chamber leading to the debris tank;

a first opening leading to a proximal end of the vacuum hose;

a second opening on an opposite side of the chamber;

a plate sized to fit in the first opening and the second opening;

a rod connected to the plate; and an actuator to move the rod and therefore the plate between the first opening, blocking the first opening, and the second opening, blocking the second opening.

6. The hydrovac of claim 1 wherein the emergency shutoff valve is positioned in a vacuum conduit in fluid communication with the debris tank.

7. The hydrovac of claim 1 further comprising: at least one water tank; a pressure sensor measuring a pressure of the water at a bottom of the water tank; and, at least one load cell measuring the weight of the debris tank, and wherein the controller further comprises an input interface operatively connected to the pressure sensor and the at least one load cell, and wherein the current weight of the hydrovac is determined using a predetermined empty weight of the hydrovac, a determined weight of the water in the water tank using a measurement from the pressure sensor, and, a determine weight of debris in the debris tank using a measurement from the at least one load cell.

8. The hydrovac of claim 7 further comprising a fuel tank and wherein the controller is further operative to use a determined weight of fuel in the fuel tank to determine the current weight of the hydrovac.

9. The hydrovac of claim 8 wherein a pair of load cells are positioned proximate a front of the debris tank and a pair of load cells are positioned proximate a rear of the debris tank.

10. The hydrovac of claim 9 further comprising a first axle for the steering wheels and an axles for the ground wheels, wherein the controller is operative to determine a weight on each axle based on the determined weight of the water in the at least one water tank, the determined weight of the debris in the debris tank, and the predetermined empty weight of the hydrovac to determine a current weight of the hydrovac.

11. A controller for controlling the operation of hydrovac having: an engine; a transmission connected to the engine, the transmission having at least one power take-off, the at least one power take-off connected to at least one hydraulic pump; ground wheels operative to be driven by the engine through the transmission; a debris tank; a vacuum hose fluidly connected to the debris tank; a boom pivotally mounted at a first end and carrying the vacuum hose; a blower operatively connected to the debris tank and operative to create a vacuum in the debris tank; a hydraulic motor connected to the blower to drive the blower, the hydraulic motor connected to the at least one hydraulic pump; an emergency shutoff valve connected in fluid communication with the debris tank; and, a boom isolation assembly which in an open position places the debris tank in fluid communication with the vacuum hose and in a closed position fluidly isolates the debris tank from the vacuum hose, the controller comprising:

at least one processing unit;

an output interface operatively connected to the engine, the transmission, the emergency shutoff valve, and the boom isolation assembly; and at least one memory containing program instructions, the at least one processing unit, responsive to the program instructions, operative to:

determine a current weight of the hydrovac;

compare the current weight to a weight limit;

in response to the current weight reaching the weight limit, open the emergency shutoff valve;

in response to the current weight reaching the weight limit, close the boom isolation assembly; and in response to the current weight reaching the weight limit, disengage the at least one power take-off.

12. The controller of claim 11 wherein the hydrovac further comprises: at least one water tank; a pressure sensor measuring a pressure of the water at a bottom of the water tank; and, at least one load cell measuring the weight of the debris tank, and wherein the controller further comprises an input interface operatively connected to the pressure sensor and the at least one load cell, and wherein the current weight of the hydrovac is determined using a predetermined empty weight of the hydrovac, a determined weight of the water in the water tank using a measurement from the pressure sensor, and, a determine weight of debris in the debris tank using a measurement from the at least one load cell.

13. The controller of claim 12 wherein the hydrovac further comprises a fuel tank and wherein the controller is further operative to use a determined weight of fuel in the fuel tank to determine the current weight of the hydrovac.

14. The controller of claim 12 wherein the hydrovac further comprises a first axle for steering wheels and a second axle for the ground wheels, and wherein the controller is operative to determine a weight on each axle based on the determined weight of the water in the at least one water tank, the determined weight of the debris in the debris tank, and the predetermined empty weight of the hydrovac to determine a current weight of the hydrovac.

* * * * *